US009428898B1

(12) United States Patent
Clements

(10) Patent No.: US 9,428,898 B1
(45) Date of Patent: Aug. 30, 2016

(54) AUTOMATIC BODY ELIMINATIONS IDENTIFYING BIDET

(71) Applicant: Sigmund Lindsay Clements, Montreal (CA)

(72) Inventor: Sigmund Lindsay Clements, Montreal (CA)

( * ) Notice: Subject to any disclaimer, the term of this patent is extended or adjusted under 35 U.S.C. 154(b) by 14 days.

(21) Appl. No.: 14/556,144

(22) Filed: Nov. 29, 2014

(51) Int. Cl.
*E03D 9/08* (2006.01)
*G05D 3/00* (2006.01)

(52) U.S. Cl.
CPC ... *E03D 9/08* (2013.01); *G05D 3/00* (2013.01)

(58) Field of Classification Search
CPC ..... E03D 9/08
USPC ..... 4/443–448
See application file for complete search history.

(56) References Cited

U.S. PATENT DOCUMENTS

| | | | |
|---|---|---|---|
| 5,201,080 | A | 4/1993 | Tanaka |
| 2015/0000025 | A1 | 1/2015 | Clements |
| 2015/0000026 | A1 | 1/2015 | Clements |
| 2015/0059076 | A1 | 3/2015 | Tiagai |

FOREIGN PATENT DOCUMENTS

| | | | |
|---|---|---|---|
| WO | PCT/KR2011/008539 | A2 | 7/2012 |
| WO | 2012086924 | A3 | 9/2012 |

OTHER PUBLICATIONS

U.S. Appl. No. 14/258,013, Sigmund Clements.
U.S. Appl. No. 14/312,697, Sigmund Clements.
U.S. Appl. No. 14/512,359, Sigmund Clements.
U.S. Appl. No. 14/585,187, Sigmund Clements.
U.S. Appl. No. 14/634,788, Sigmund Clements.
U.S. Appl. No. 14/791,895, Sigmund Clements.

*Primary Examiner* — Lori Baker

(57) ABSTRACT

A bidet automatically washes bodily excretions, such as, feces, urine and or blood, off of a user's front and or back elimination positions, and posterior. Cameras with differing light filters, are used to view the differing excretions. A light projects light of differing wave lengths, to illuminate the differing excretions. The camera detects the different illuminated excretions. Detected excretions on the posterior, are automatically washed by, a computer, directing water on the excretions. A display shows the detection, and washing process of the excretions. Hands free operation of the bidet, lessens the chance of bacteria being transferred to the user's hands, while using the toilet. The display visually assures the user, that excretions are removed from the posterior.

27 Claims, 15 Drawing Sheets

AUTOMATIC BODY ELIMINATIONS IDENTIFYING BIDET

This application claims the benefit of provisional patent application Ser. No. 62/081,579 filed 2014 Nov. 18, 1062/048,616 filed 2014 Sep. 10, 62/044,414 filed 2014 Sep. 2, 62/033,634, filed 2014 Aug. 5, 62/021,110, 2014 Jul. 5, 17, 62/009,163 filed 2014 Jun. 7, 61/954,567 filed 2014 March, 61/946,789 filed 2014 Mar. 1, 61/922,755 filed 2013 Dec. 31, 61/916,298 filed 2013 Dec. 16, 61/912,024 filed 2013 Dec. 5, 61/910,299 2013 Nov. 30, 61/896,117 filed 2013 Oct. 27, 61/890,186 filed 2013 Oct. 12, 61/889,167 2013 Oct. 10. This application claims the benefit of patent application Ser. No. 14/312,697 filed 2014 Jun. 24, Ser. No. 14/258,013 filed 2014 Apr. 22, Ser. No. 13/928,378 filed 2013 Jun. 27, Ser. No. 13/927,111 filed 2013 Jun. 26, by the present applicant.

FEDERALLY SPONSORED RESEARCH

None

SEQUENCE LISTING

None

BACKGROUND FIELD OF THE EMBODIMENTS

This applications relates to electric bidets specifically to improvements in a bidet's automatic washing of a user's posterior.

BACKGROUND OF THE EMBODIMENTS

Electronic toilet bidets, may refer to devices that are mounted on a toilet, usually located at the back of the toilet bowel. The bidet enable a user to wash a female's front, and or back elimination positions, or a male's back, elimination position. The bidet streams water on to a user's elimination positions, after elimination. The bidet moves the water stream to a default bidet front and or back elimination position.

Bidet cleaning wands extending beneath the users posterior. Water jets, streams of water, are emitted from a cleaning wand nozzle, and are directed at the posterior. The water washes the posterior's back, and front elimination positions. The bidet moves the water stream to a default front, and or back elimination position. The bidet can adjust the ejecting position, or area of the bidet nozzle spray, by adjusting the wand nozzle position, also the water pressure can be adjusted.

Wands can move, for example, by oscillating back and forth, and rotating side to side, to change the direction of the water stream. An air drier dries the user's posterior after being washed. Warm air is directed at the user's posterior.

The user operates the bidet by touch activating dedicated buttons on a control panel corresponding to various toilet devices, for example, the user presses a bottom wash button. The wand nozzle extends beneath the user's posterior, and a stream of water is emitted, directed at the posterior, which washes the posterior. Adjustments to the wash spay, are made by touching adjustment buttons on the panel. The bidet wand can move backward forth, or rotate side to side, which increases the water's cleaning area. The nozzle water stream can pulsate, which can massage the back and or front of a user.

Washing with water more effectively reduces the likelihood of bacteria germinating. Using only toilet paper can actually spread bacteria across an area as opposed to cleaning it away. Bidet usage can provide a hands-free experience, the hands stay on their lap, while the bidet works beneath them.

Bidets are very effective for maintaining feminine hygiene during menstruation. Bidet toilet seats are useful for those who have particular medical conditions. For example, users might have diminished strength in their hands or arms. They are also very hygienic for men to use along with or in place of toilet paper. Reducing toilet paper consumption also, reduces overall paper waste.

The bidets and bidet attachments are ideal for men, women, children and the elderly. When users get older, using the restroom can become an increasingly difficult task. Some turn to care-givers for assistance with wiping. This can lower a person's self-esteem, by having to depend on someone else to use the toilet. A bidet can help restore confidence and allow the user to regain their independence.

In Yeong Mo Jung, Bidet And Method For Controlling Same, Publication number WO2012086924 A2, publication date Jul. 28, 2012, Application number PCT/KR2011/008539 Republic of Korea, the electric bidet uses a camera to view how well the bidet cleaned the elimination position, but doesn't use the camera's view to aid the user or computer, in directing the bidet's water stream at the elimination positions.

Disadvantages

Thought bidets usefulness has been demonstrated disadvantages exist.

(a) To operate a bidet a user needs to touch input into a bidet control panel. The panel may have bacteria on it. The bacteria may be transferred from the panel to the user's hand, and then from hand to mouth, etc. What is needed is a way to operate the bidet touch freely, or have the bidet automatically operate its self, to avoid the user having to touch control panel.

(b) It may be difficult for a user or a computer to direct and aim water at a desired location, on the user's posterior. An improved bidet is needed, that allows the user or computer to direct the bidets water stream different locations on the posterior.

(c) It may be difficult for a user to view bodily excretions viewed by a camera, and shown on a display, when they are viewed with regular light. The viewing difficulty may make it challenging for a user, or computer to visually direct water at bodily excretions on a user's posterior. A way is needed to make excretions easier to view. Easier viewing of the excretions, makes it easier for water to be directed at them, and for the user to see, when all the excretions have been removed.

(d) A problem for bidets is that they direct water at default elimination positions, though users are different shapes, and sizes, and have different sitting styles on a toilet seat, which position the user's elimination positions at different locations on the toilet seat. A bidet that directs water at a user elimination position, regardless of their position on the toilet seat, or body shape, could improve the washing of the user.

(e) Some people may have difficulty in to learning how to operate a bidet. A bidet with little or none learning curve, is needed.

(f) Though bottom air driers are efficient at drying an elimination positions, a user may needed to user toilet paper to remove any remaining water. A way for the user to direct a stream of air, or for a computer to automatically identify, and direct a stream of air at any remaining water on the posterior, would be helpful.

SUMMARY

This Summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

This summary relates to two main embodiments of bidets. A first bidet embodiment automatically detects fecal matter, urine or blood on a user's elimination positions, and aims the water stream at the detected fecal matter, urine, and or blood. A second bidet embodiment automatically identifies and aims the bidet water stream, at the user's front and or back elimination position.

The first bidet, an automatic excretion identifying bidet, uses a camera with light filters to detect bodily excretions. The excretions are highlighted by differing light waves and illuminate, fecal matter, urine and or blood, on the elimination positions, and posterior. The user, or bidet computer can view the highlighted fecal matter, urine and blood, on the display. The user, or computer can watch the cleaning of the elimination position on the display. The user can manually direct the bidet water stream at the excretions. The bidet washes the viewed excretion, until they aren't detected on the posterior.

In the second embodiment an automatic water aiming bidet is used. The bidet automatically directs a stream of water at the user's elimination positions, without the need for the user to move their body to the stream of water. The bidet automatically, identifies the user's elimination position, and positions location. The bidet washes the position with water.

The viewed cleaning of the user's elimination positions can be recorded, and saved for later viewing, and possibly shown to health care workers if a health care is views by the user.

In a third embodiment an automatic bidet is used to identify the used elimination position which to direct water to. The automatic bidet identifies the user's gender, and identifies the elimination position and or positions which have been used to eliminate from, to determine which elimination position or positions which to direct water to.

The differing bidets can be used in to complement each other. For example the automatic aiming bidet can wash the used elimination position, and them the automatic excretion identifying bidet can wash off any remaining detected excretions on the posterior.

An example of the bidets operation follows. After the user eliminates, the computer identifies the elimination position and the use's gender. The automatic bidet moves, the bidet's position to a default position near the user' front or back elimination position. The water nozzle is moved to the elimination position to be washed.

At the user' front or back elimination position the camera visually searches for the user' elimination position. The elimination position's location is identified. The elimination position water aiming bidet, identifies the location of the elimination position. The bidet streams water to the elimination position, and surrounding area. The water cleans the elimination position and area. The computer visually monitors the waters stream on the elimination position, to maintain the stream on the desired position. If the user moves, the water stream will follow the elimination position.

Any blood, urine, and or fecal matter on the posterior after washing be the water is identified, by the cameras, and camera light filters. The bidet moves the water stream to the identified fecal matter, urine, and or blood. The water steam removes the blood, urine, and or fecal matter Advances in technology have made improvements in bidets possible. The advancements have been in a range of technologies, such as, a miniaturisation of video cameras, a miniaturization of displays, an increases in the speed and storage abilities of computer processors, advances in genital recognition software, and developments in mid-air hand gesture recognition software, etc. The growing popularity of bidets have fueled advancements in their development. Bidets have become more attuned to a user's needs, and the increasing advantages of bidets has come to the present now.

Advantages

In the preceding description, a number of advantages of some embodiments of the automatic excretions identifying bidet, and automatic aiming bidet, become apparent.

(a) The bidet's computer directs water at the elimination position, regardless of the user's position on the toilet, the users shape, and size.

(b) The user and or computer can view highlighted fecal matter, urine, and blood on their elimination positions, and clean the positions until they achieve the desired cleanliness.

(d) The user can view, shown on a display, the water stream on their elimination positions.

(e) The user doesn't need to touch the control panel, to direct the water stream to a desired location.

(f) The user doesn't need to learn how to direct the water stream to a desired location, with the control panel.

(g) The user is assured that they thoroughly cleaned, by their viewing their elimination position on a display, and the computer analysing, and viewing of the elimination position, (h) The viewed cleaning of the user's elimination positions can be recorded, and saved for later viewing, and possibly shown to health care workers if a health concern is viewed by the user.

(i) Computerized cleaning of elimination positions leads to a more sanitary environment, by removing fecal matter which may be go thru clothing and contaminate seats, and seat cushions. Seats which may be touched by a user's hands when sitting, and lead to bacteria being transferred to the user's hands, and from hands to month, or to other user's hands, and from hands to other surfaces.

BRIEF DESCRIPTION OF THE DRAWINGS—FIGURES

The drawings, closely related figures may have the same number but different alphabetic suffixes. The embodiments are illustrated by way of example and not limited in the accompanying figures in which like reference numerals indicate similar elements.

Figure 1:
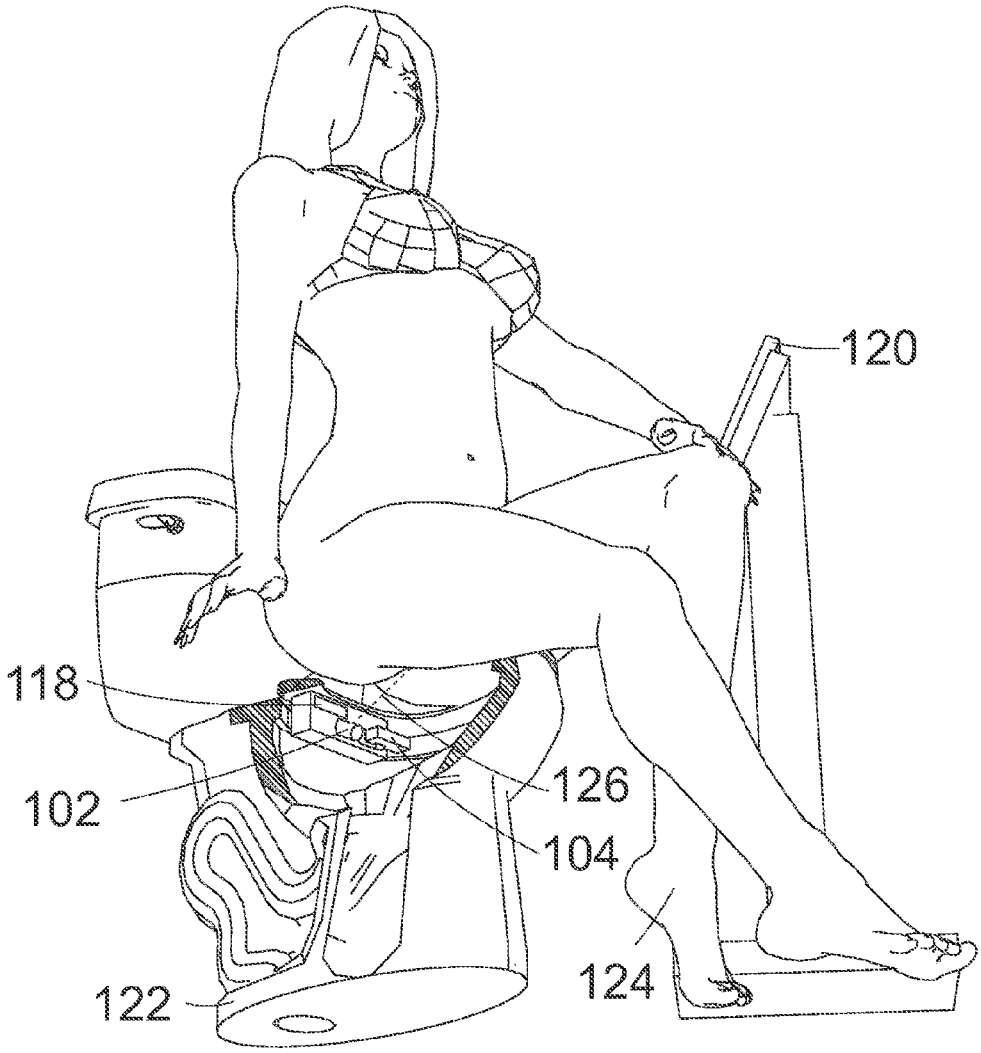
FIG. 1 shows a perspective view of a user manually operated excretion identifying bidet, a sectional view of a toilet, and a display.
Figure 2:
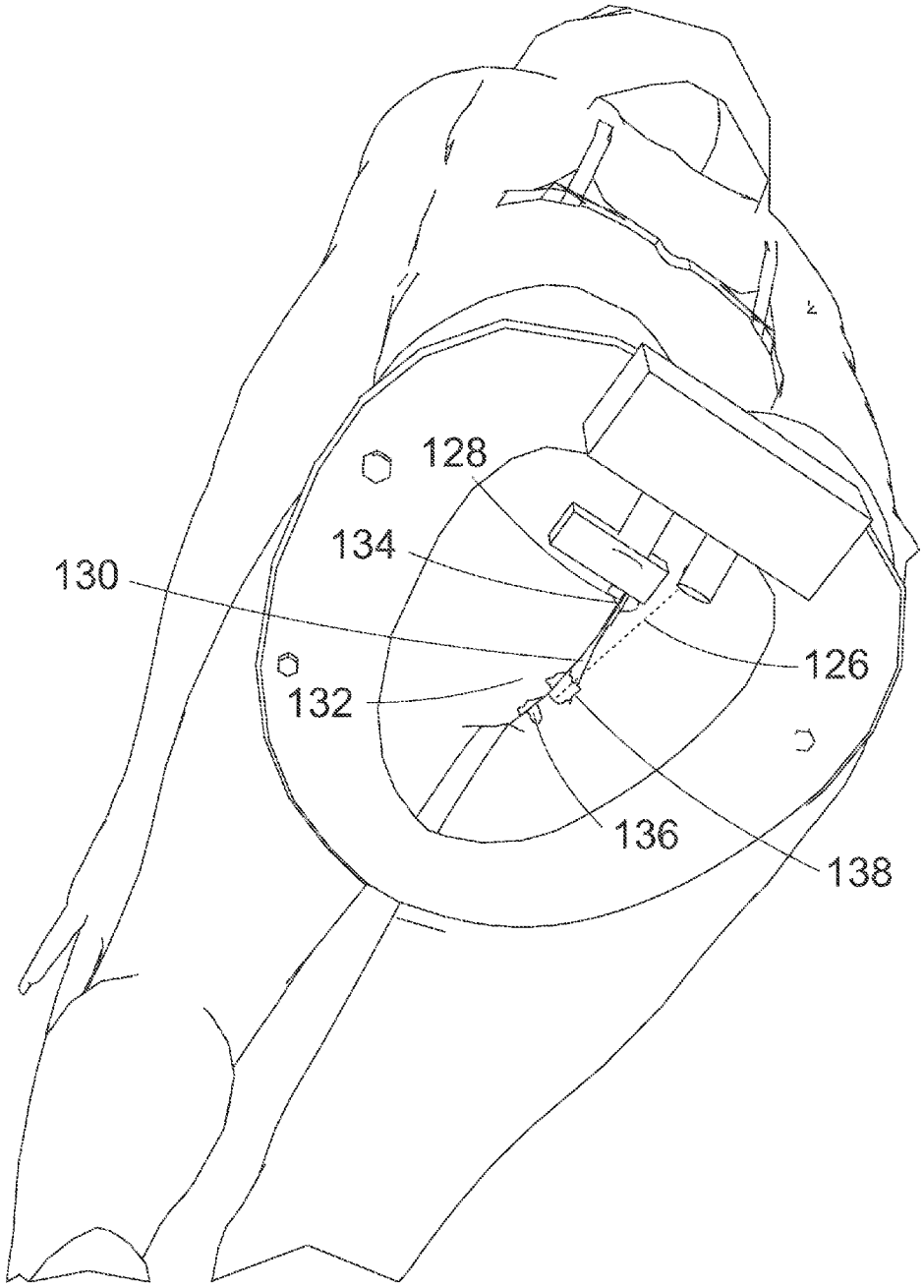
FIG. 2 shows a perspective view of the user, an exploded view of the toilet, and the bidet.
Figure 3:
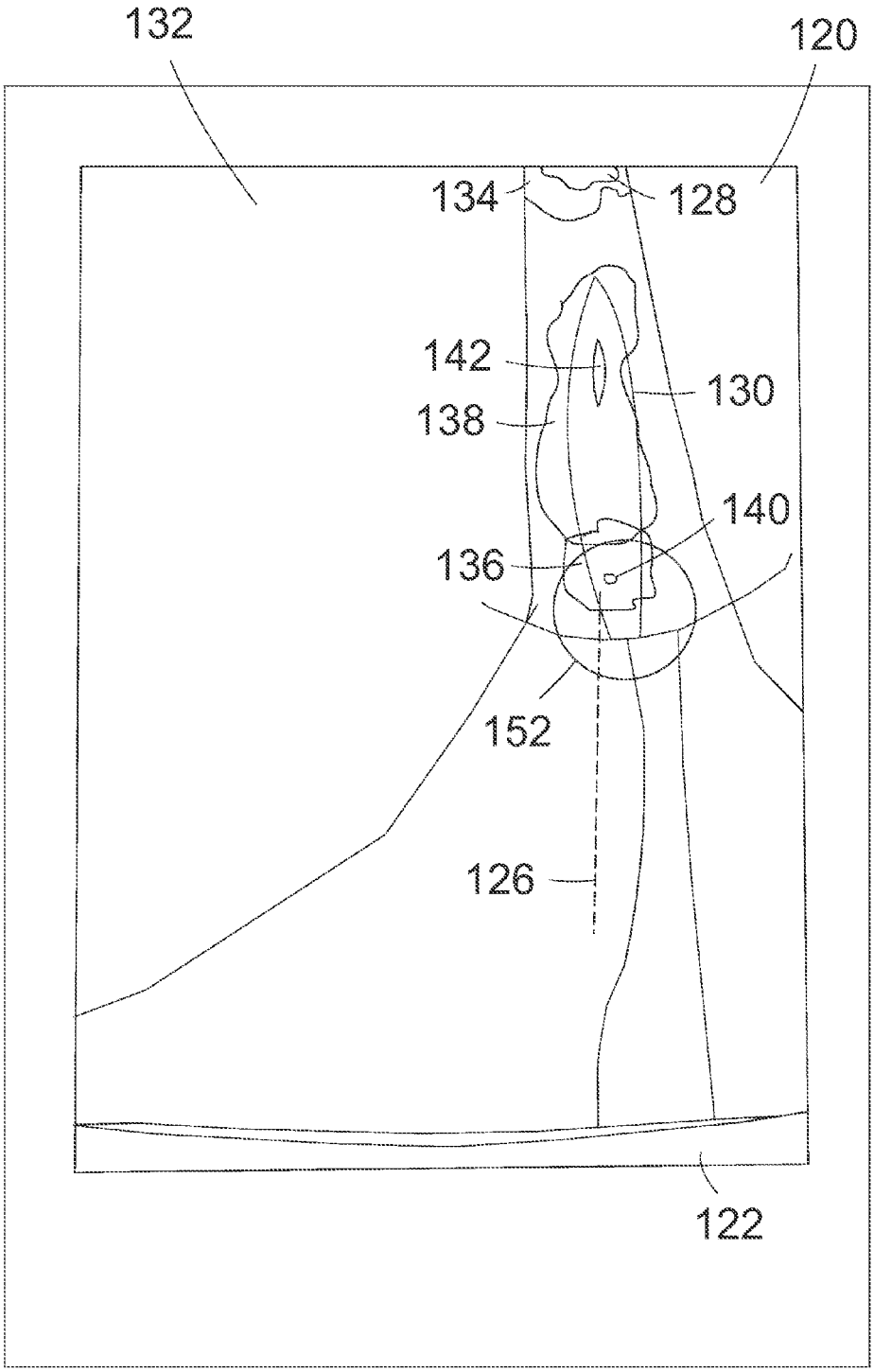
FIG. 3 shows an orthogonal view of the display showing highlighted bodily excretions, on the user's elimination positions.
Figure 4:
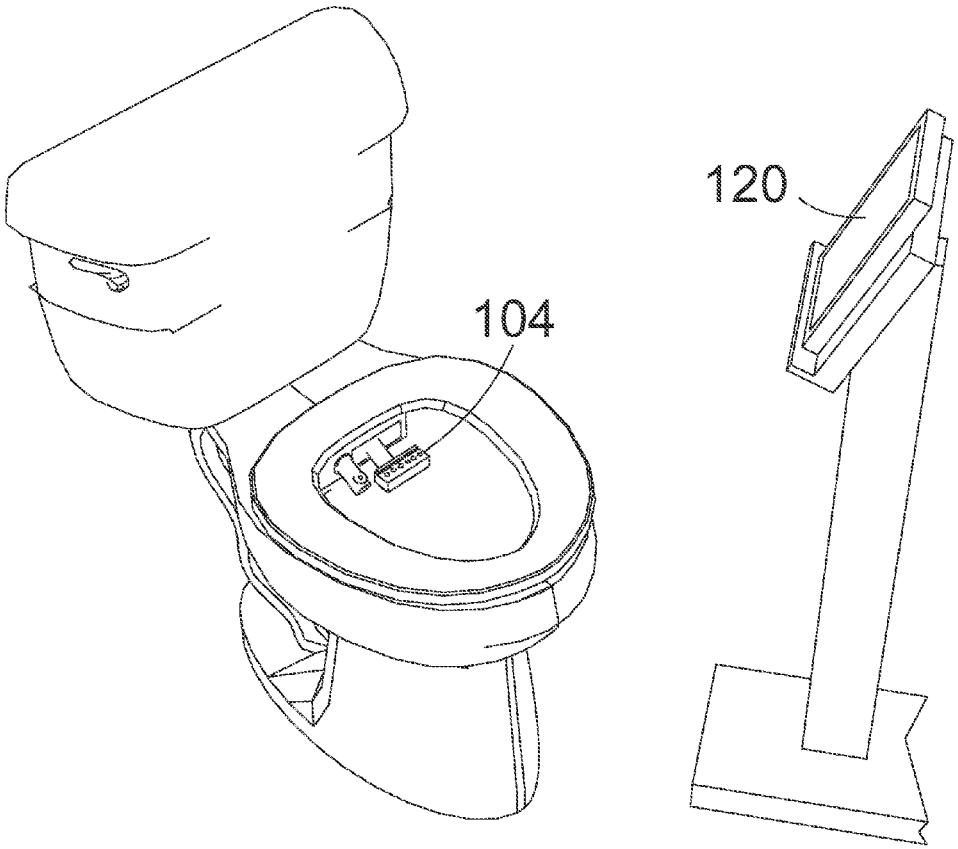
FIG. 4 shows a perspective view the manually operated excretion removing bidet, the toilet, and the display.

Other advantages may become apparent from the following detailed description when taken in conjunction with the drawings.

REFERENCE NUMBERS

102 bidet cleaning wand
104 cameras and light bar
106 water nozzle
108 feces camera
110 feces illuminating light
112 regular camera
114 urine camera
116 urine illuminating light
118 bottom air dryer
120 display
122 toilet
124 user
126 water stream
128 anus, back elimination position
130 vulva
132 posterior
134 feces, fecal matter
136 urine
138 blood
140 urethra, or front elimination position,
142 vaginal opening
144 blood illuminating light
146 air blowers lens cleaners
148 regular light
150 light and camera wand
152 touch input water directing area
606 water nozzle
610 feces illuminating light
612 urine illuminating light
620 display
612 blood illuminating light
620 display
646 air blowers lens cleaners
648 regular light
654 3D mid-air hand gesture controller
656 lens with two light filters
656 lens with illuminated feces light filter
656 lens with illuminated urine light filter
656 regular lens for detecting illuminated blood
658 back elimination position cleaning wand
660 front elimination position cleaning wand
662 air blower nozzle
664 water nozzle
812 regular camera
820 display
912 regular camera
920 display
1006 back wash
1012 regular camera
1020 display
1024 air drier nozzle
1066 front wash water nozzle
1412 regular camera
1448 regular light
1506 back position water nozzle
1566 front position water nozzle Further features of the embodiments, its nature and various advantages will be more apparent from the accompanying drawings and the following detailed description of the embodiments.

First Embodiment

Highlighting Bodily Excretions on the Posterior to Allow a User to View them and to Operate a Bidet to Remove them Description A user views the posterior with a regular light, white light electronic video camera, to look for possible bodily excretions. A regular light, white light 148 is attached to a bidet light and camera wand 150. The light illuminates a user's posterior. A display 120 shows the camera's view of the posterior, a bidet's water stream contacting the posterior. The display is viewable by the user. The user uses the view of the bidet's water stream to aid in visually directing the movement the water stream to a desired location on the posterior.

The user 124 uses the camera's 112 view to aim a stream of water 126, at their elimination positions, and posterior, while sitting on a toilet seat 122. The camera's view shows were the bidet's water steam 126 contacts the user's elimination positions, and posterior 132. The user moves the water stream on the posterior, to wash off bodily excretions.

The camera 112 is attached to a bidet camera and light bar. The bar 150 is attached to a light and a cleaning wand wand150. The stream of water 126 emanating from the cleaning wand 102 can be aimed at their elimination positions, and posterior while the user is sitting on a toilet seat 122. The camera and light wand, and cleaning wand 102 move to together, enabling the cameras to view the water stream on the posterior. Viewing the water stream enables the water stream to move to desired locations on the posterior.

Cameras are used to detect bodily excretions, such as, blood 138, and or fecal matter 134, and or urine 136, on the user's posterior. The user can highlight which excretion they want to visually search for, by activating a light which specifically highlights one of the excretions they want to search for. Each excretion has a light frequency that specifically highlights the excretion. The different light frequency is used for highlighting each different excretion. The camera can use a light filter specific to the illuminated excretion's light, view the highlighted excretion. The camera and light is activated by the user's touch input into the display.

The user touch activates the camera from a menu of differing camera views, on the display. The user can chose from the menu, the camera view they want to use to view the posterior, such as, a regular camera view, a fecal camera high lighting view, a urine high lighting camera view, and a blood camera high lighting view. The cameras can be activated individually or, together, such as, the fecal viewing camera, and the blood camera, can be used together, to show on the display both highlighted excretions simultaneously Each excretion can be assigned a differing color on the display, such as, feces can display the color green, blood can display the color red, urine can display the color orange. The regular light camera would show the regular color of the posterior.

The lights luminosity can be brightened or lowered by the user, by using a light brightness menu on the display. The camera lens has a lens covering that keeps the lens dry, and protects the lens from wear. Air nozzles 146 blow water, and fecal matter off the cameras lens covering. The blowing air keeps the lens view clear of water. The bidet is inside the toilet bowel 122. The bidet has a view of the user's posterior, and elimination positions. The display can show two views of the posterior simultaneously, such as, the regular light view, and the fecal illumination view. The lights, the cameras, the display, and the bidet, are water proofed.

Feces 134 is detected by using a feces Blue illuminating light 110 which illuminates an area on the posterior which is to be examined. The blue light is in the 380-470 nm wave length range. If fecal contamination or ingesta is present on the object, the feces will fluoresce at approximately 675 nm, +/−10 nm, such fluorescence can then be visibly detected by the camera which has a light filter which enable the viewing of the fluorescence. Such fluorescence will appear red to the camera's eye. The camera and blue light is attached to a bidet camera and light wand. This optical characteristic is ubiquitous in animals that consume plant material, particularly plant material containing photosynthetic pigments such as chlorophyll.

Other cameras or sensors could be used, such as, a laser-induced fluorescence imaging system (LIFIS) allows acquisition of fluorescence from feces-contaminated skin in ambient light. Bioindustrial Machinery Engineering Dept., Chungnam Natl. Univ., 220 Gung-dong, Yuseong-gu, Daejeon, 305-764, Republic of Korea. Fluorescence emission images at 630 nm were captured with 415-nm laser excitation. Image processing algorithms including threshold and image erosion were used to identify fecal spots diluted up to 1:10 by weight with double distilled water. Feces spots on the body, without dilution and up to 1:5 dilutions, can be detected with 100% accuracy. Detection accuracy for fecal matters diluted up to 1:10 is 96.6%.

A LED blue light, in the 410 to 420 nm light wave length can also be used to high light feces on the user's posterior. The camera views the highlighted feces.

Blood 138 is detected by, a LED blue light, in the 415 nano meters light wave length range is used to highlight blood on the user's posterior. A camera views the highlighted blood. Blood may be on the front elimination positions, urethra, 140, vulva 130, vaginal opening 142, and or back elimination position, anus, or anal opening 128. The blood is viewed using the camera. The iron in the blood appears dark to the camera, and eye when highlighted. The camera, and blue light are attached to the bidet camera and light bar 150.

Other cameras or sensors could be used, such as, a camera which pluses infrared light at the posterior, and uses a light filter on the camera which detects the reflected infrared light, which indicates the presence of blood. The camera described is developed by Stephen Morgan, Michael Myrick at the University of South Carolina in Columbia, and can detect blood even when the sample has been diluted to one part per 100. The camera beams pulses of infrared light onto a surface and detects the infrared light that is reflected back off it. A transparent, 8-micrometer-thick layer of the protein albumin placed in front of the detector acts as a filter, making dilute blood show up against its surroundings by filtering out wavelengths that aren't characteristic of blood proteins.

Urine 136 is detected by, an ultraviolet light emit diode LED, directing light at the posterior. The ultraviolet light is used at a 365 nm light wave length to fluoresce, highlight urine on the users front elimination position, and posterior. A camera with a light filter for allowing the light reflected off of the urine to be detected, views the fluoresced urine.

The camera lens's has light filters, which highlights fecal matter, urine and or blood, on the user's elimination positions, and posterior. The highlighted fecal matter and or blood is viewable on the display. The user can direct the water 126 at the highlighted fecal matter, urine and or blood, until they are removed. The highlighting of the fecal matter, urine and blood allows the user to see how much fecal matter, urine and or blood is on their posterior. The user can detect when their posterior is clean, by viewing the display to see if any fecal matter 134, urine136, and or blood is left on their posterior 132. The user can stop washing their posterior when they have reached the desired posterior cleanliness.

When fecal matter is searched for, the fecal matter camera, has a fecal matter light filter, which covers the camera lens 108. The feces illuminating light 110 is activated, fluorescing the feces. Water 126 is sprayed on the highlighted feces. After the water removes the feces, blood is searched for. The blood is illuminated, by a blood illuminating light 144, and the camera 112 looks for darkened areas that are created by the light illuminating the iron in the blood. When the urine is searched for, the camera with the urine light filter which covers the cameras' lens 114 is used. The urine illuminating light 116 is activated, fluorescing the urine. Water is sprayed on the highlighted urine. Liquid urine washes of the posterior easily. Dried blood and or dried feces on the posterior, may require a longer washing cycle, then when they are in the liquid form.

The user can individually highlight the excretions, such as highlighting feces, and then washing off the feces. The user can then highlight possible blood, and then wash off the blood, and next highlighting urine. The user touch activates a camera option on a menu of different camera view options, which are shown on the display. The user activates the camera they want to use to view the posterior. The user can turn off the lights highlighting the excretions, and view and clean the posterior, with regular lighting 148, illuminating the posterior areas.

The computer is connected to a motor controller. The motor controller is connected to the bidet's components. The computer instructs the motor controller, to supply power or discontinue the supply of power to individual components. The fecal highlighting light, the urine highlighting light, and the blood highlighting light, are connected to the motor controller. The motor controller is connected to a power supply.

The cameras, the display the bidet are connected to the computer, to allow the computer to send operating instructions to the components. The instructions direct the components operation.

The user can move the water steam to a desired location on the posterior. The user moves the bidet cleaning wand 102, by using a bidet moving input device connected to the computer, such as, a joystick, a mid-air and gesture input device, or a touch screen controller, etc. The cleaning wand and camera wand can move left and right, up and down, retract and extend, to view the user's, posterior, and stream water to different locations on the posterior.

A touch screen on the display, is used to move the water stream. The user views where the water 126 contacts their posterior on the screen. The water is directed in a defined visual area 152, by touching the area on the touch screen controller 152. The water stream positioning area moves to the touched location on the display, and is then touch activated. The water stream 126 will clean the touched visual area. The user touches a different area, to move the visual water stream positioning area 152 to the new touched area. The water stream will move to the water stream positioning area, and the new touched area.

The water stream positioning camera's area, can be zoomed in and zoomed out, on views of the posterior. The camera 144 follows the water stream positioning area, to maintain the view in the center of the display. The water stream positioning area can be enlarged or made smaller, on the posterior. The area that water is streamed to, can be enlarged or made smaller.

The user views their posterior on the display. The user eliminates while on the toilet seat. The user views highlighted fecal matter, urine and or blood on the elimination position, and posterior. The user may also wash off viewed body excretions, by using the touch screen input bidet moving device, to move the water stream to the excretions. The user may wash off fecal matter, urine and or blood on the elimination position, 128 which has accumulated without eliminating, such as, blood, which is detected after eliminating. When the posterior achieves the desired cleanliness, the user discontinues water stream.

The display shows a menu of bidet inputs, such as, warm water temperature, water on or off button, activating a bottom air drier 118, and a pulsating water spray, etc.

The electronic video cameras are attached to the bidet camera wand. The computer receives images from the cameras in real time. The computer is connected to the display. The computer sends the received images to the display.

The computer is located in the display 120. The bidet wand moving device is connected to the computer by radio waves, such as, Bluetooth, or WI fi, near WI fi, etc. The computer is connected to the bidet wand moving device. The computer instructs the bidet wand moving device to move to a location inputted by the user.

The computer is programmed with bidet wand moving software, with fecal matter, urine and or blood highlighting software, computer operating software, user bidet wand input moving software, and bidet operating software, etc.

Figure 5:
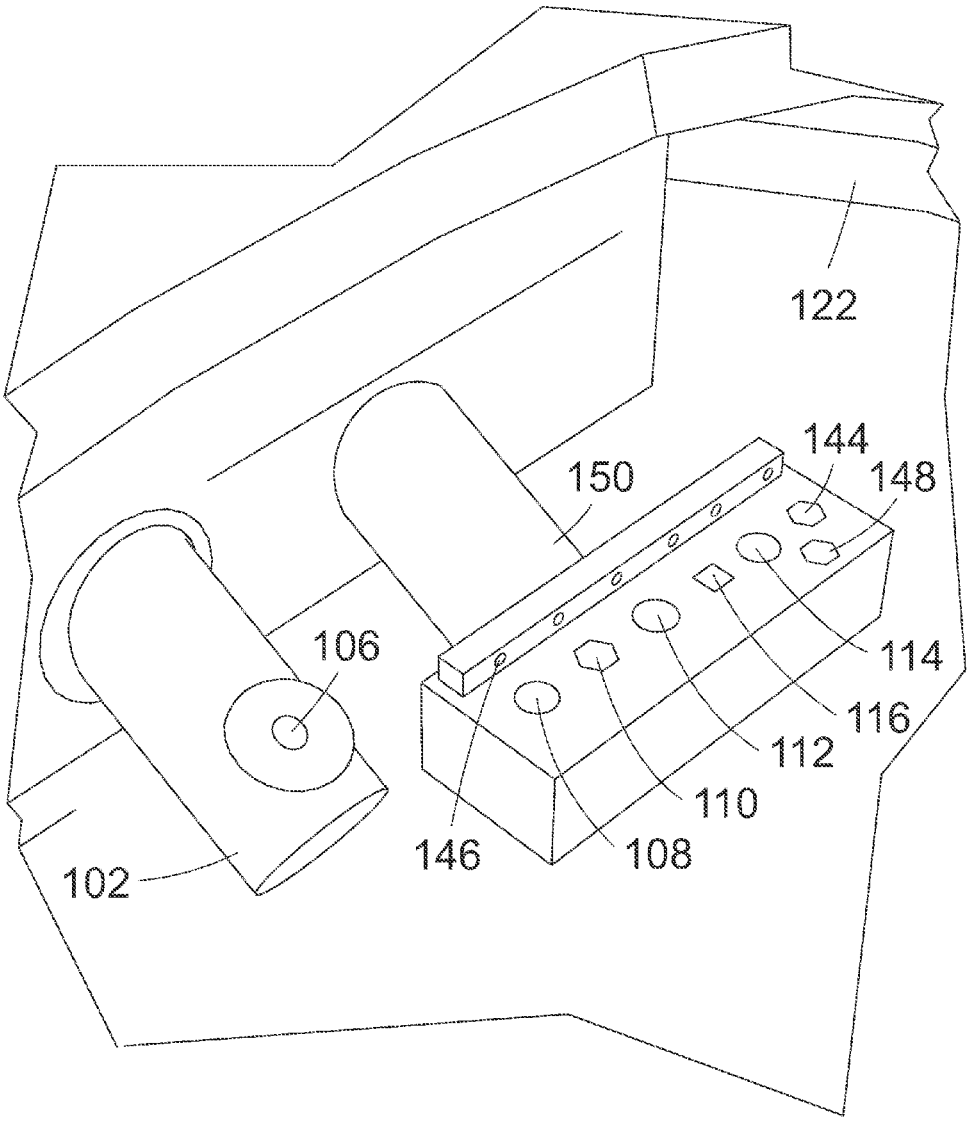
FIG. 5 shows a close up perspective view of the manually operated excretion removing bidet.

Realsense cameras made by the Intel Company, are used for imagining of the user's posterior, genitalia, and front and back elimination positions, as illustrated in FIG. 5. Other imaging cameras, or sensors could be used, such as, a Kinect technology camera sensor made by the PrimeSense company, a Kinect camera made by the Microsoft company, a XTR3D made by Creative Reality, of Herzelia, Israel. Imaging sensors could be used, such as, a Leap sensor, an Epileptic Labs ultrasonic 3D sensor made by a company in Sweden, a Kinect technology camera sensor, a Haptix gesture recognition chip, a Flutter gesture recognition system, a Infineon 3D Image Sensor, an infrared sensor, and a night vision infrared camera, etc. A Cambord Pico camera made by the Optoma Company of Watford, United Kingdom could be used.

Highlighting Bodily Excretions on the Posterior to Allow a User to View them and to Operate a Bidet to Remove them Operation The user can view urine 136, blood 138 and or fecal matter 134 on the user's elimination positions, as illustrated in FIGS. 1,2,3,4, and 5. The user can view urine 136, blood 138 and or fecal matter 134 being excreted from the user's elimination positions. After using the toilet 122, and the elimination process has stopped. The user views the posterior with the regular light camera, to look for possible excretions. The user washes off possible feces.

The user individually highlights the excretions, on their posterior. The user highlights feces, and then washing off the feces. The user then user highlights possible blood, and washes off the viewed blood.

To wash off the excretions, the user touch activates the camera on the menu of camera views on the display. The user highlights urine. A view of the highlighted urine on the posterior is displayed. The user moves the bidet cleaning wand water nozzle 106 to the urine, by touching the position on their viewed posterior show on the screen 120. The user touches the on button, and water is streamed from the water nozzle, to the urine. When the viewed urine on the posterior position is washed. The water can be stopped by activating the off button. The user touches another urine position to be washed, the water stream moves to the new touched position, and streams water on the new position. Different positions are washed, until all the desired positions are washed. The user activates the bottom air drier 118, after the washing, to dry the bottom.

Alternate Embodiments

An Automatic Excretion Identifying Bidet Description and Operation

An automatic excretion identifying bidet comprising, a computer, a camera, a light generating different light wave lengths, and light filters on the camera visually identify fecal matter, urine, and or blood, and their location on a positron. The computer activates the water stream, and directs the bidet water at the position of the excretions. The computer views the highlighted excretions, and sprays water on them until they are removed, and no longer viewable. The computer detects when the excretion have been removed. After the excretions are removed, the computer washes the remaining unwashed elimination position area.

The automatic excretion identifying bidet and water aiming device is user to wash a user's posterior. The user sits on a toilet seat and eliminates. The computer connected to a camera 1012, visually detects elimination coming from the user's elimination position or positions, in FIGS. 10 and 11. The computer visually detects when elimination has stopped. To be sure elimination has stopped, the computer waits 45 second from the last detected elimination, before elimination is searched for. After elimination is detected stopping, blood, urine, and or fecal matter on the posterior is identified, by the cameras, and camera light filters. The bidet moves the water stream to the identified fecal matter, urine and or blood. The water steam removes the blood, urine, and or fecal matter.

Both front and back female position elimination positions can be cleaned at the same time. Using one cleaning wand 1066 to clean the front elimination position, and a second cleaning wand 1006 to clean the back elimination position. The wands clean the elimination positions simultaneously. If bodily excretions, aren't recognized, the user's posterior isn't washed. The display 1020 will show a message, informing the user that their posterior won't be washed. The user has the choice, to manually wash their posterior.

The computer views the water's contact on the excretions, and streams the water on them, until they are removed. The water stream can move in differing patterns, such as, moving back and forth, oscillating, pulsating, a dispersed spray pattern, a narrow water stream, a sweeping spray, and an angled stream, etc.

The search for fecal matter, blood and urine is done sequentially, one after another. The excretions are discovered individually, the light to illuminate each one is activated individually. When one light is on, the other lights are turned off, for example, when the feces identifying blue light illuminates the posterior, the other lights are deactivated. The excretions are washed individually after each one is identified. When feces are identified, water is stream on the feces. When blood is identified, water is streamed on the blood. When urine is identified, water is stream on the urine.

The computer means is a processer connected to a storage, for analysing data and storing data. The computer means, is the computer programmed with bidet operating software, genital gender recognition software, elimination detecting software, elimination starting and stopping detecting software, and position of elimination detecting software. The camera and sensor means is the cameras and sensors. The bidet means is the bidet. The toilet means is the toilet. The display means is the display.

The computer is programmed with bidet wand moving software, with fecal matter, urine, and or blood highlighting software, computer operating software, user bidet wand input moving software, and bidet operating software, computer operating software, mid-air hand gesture three dimensional input sensor software, and display software, etc.

Software is used for directing water at the highlighted blood, urine and or fecal matter and moving the water spray in a pattern that eventually covers the excretions. Software is used for determining when the excretions have been removed. Blood, urine, and fecal matter camera illumination detecting software is used.

To activate the automatic excretion identifying bidet, without using the toilet, eliminating excretions to activate the automatic bidet, the user sits on the toilet. The blood and or fecal matter on their posterior is highlighted and identified. A clock on display shows a countdown until to activation. After 90 seconds, the water stream is aimed at the detected blood, urine, and or fecal, and removed. This may be beneficial for women menstruating, who can use the bidet without eliminating excretions. The countdown time can be changed by the user.

Water recognition, identifying software is programmed into the computer. After the elimination position is washed, the camera visually searches for water, and water droplets on the posterior. A water illuminating light, and detecting light can be used, to allow the camera to detect the water. When water is found, the computer aims an air drying nozzle 1024 at the recognized water on the elimination position, and posterior. Warm air flows out of the air dyer nozzle 1024 physically removing water, and dry's, evaporate the water. The display highlights the detected water. The user views, on the display, the air stream's contact with the water posterior.

The user can also manually aim the air nozzle and air stream, at the posterior. The user uses an input display, connected to the computer, to manually move the air steam to desired locations on the posterior. The user uses the display to view the water on the posterior, and to view the air streams location on the posterior, the user uses visual clues, to visually direct the air stream to the water. The user view when the water is removed.

The user can change the amount of excretions to be removed, such as, 91%, or a limit of the amount of time the bidet spends cleaning the posterior, such as 45 seconds. The limit on the cleaning cycle would be used to avoid possible continuous cleaning of the posterior, created by a continuous out flow of bodily excretions.

The computer, fecal matter and or blood may not be able to be 100 percent removed. In the case of menstruation, blood may be flowing continuously. Feces may not be removable from the eliminatory opening, if the opening isn't completely closed, or is experiencing a continuous flow of feces caused by, a conditions such as, diarrhea. The user can limit the time period that the computer washes the user, or limit how much of a percentage the excretion is cleaned off of the user.

In the detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The object detection and selection mechanism is described below with reference to flowchart illustrations and or block diagrams of methods, apparatus (systems) and computer program products according to implementations thereof. It will be understood that each block of the flowchart illustrations, FIGS. 12 and 13, and or block diagrams, and combinations of blocks in the flowchart illustrations and/or block diagrams, can be implemented or supported by computer program instructions.

These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Figure 10:
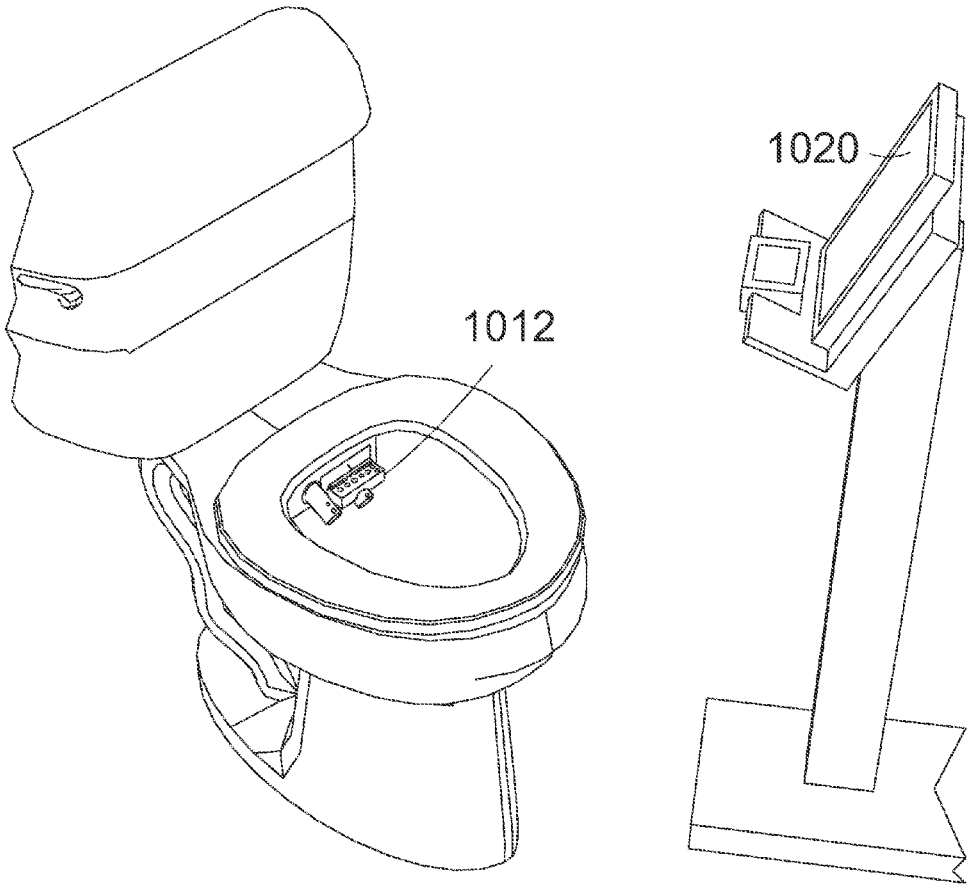
FIG. 10 shows a perspective view of an automatic excretion identifying bidet, automatic air drier, and a display.
Figure 11:
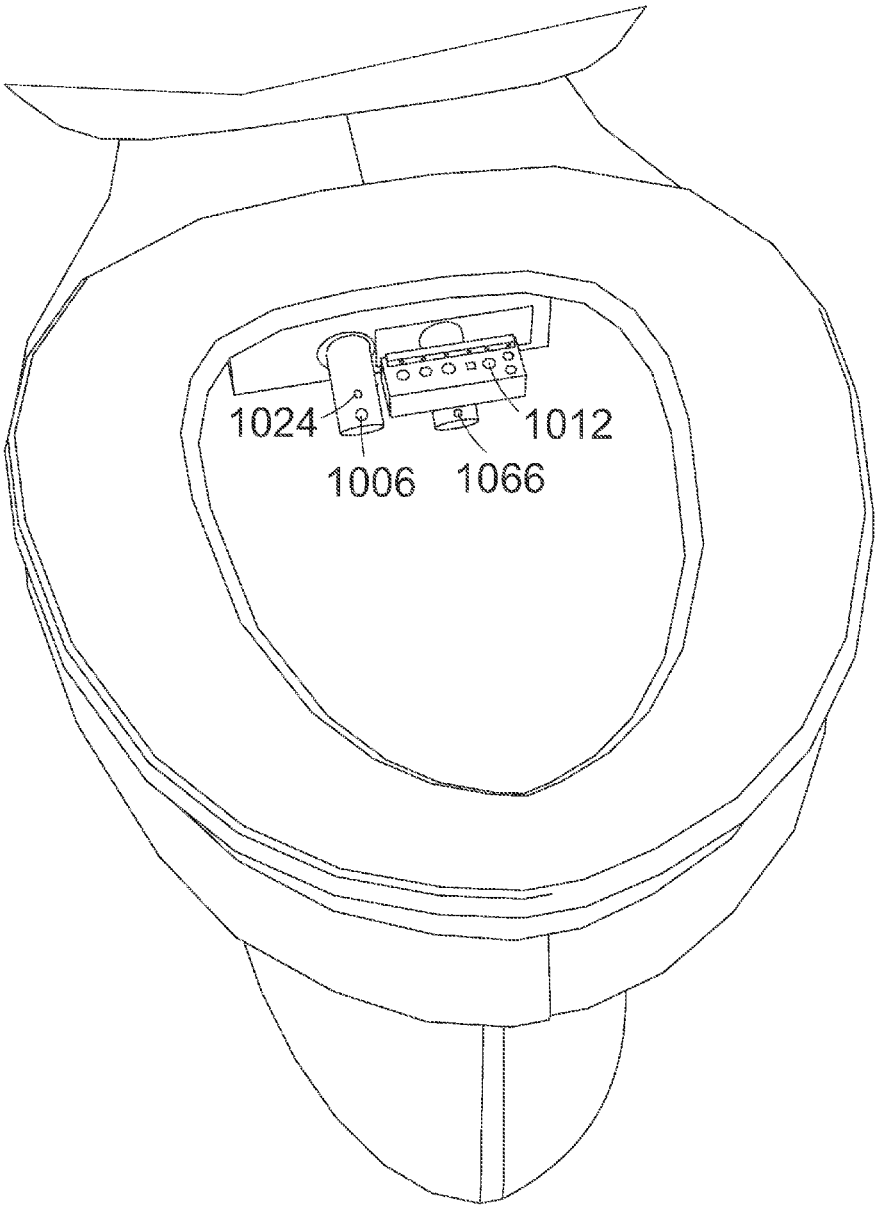
FIG. 11 shows a close up perspective view of an automatic excretion identifying bidet, and a display.
Figure 12:
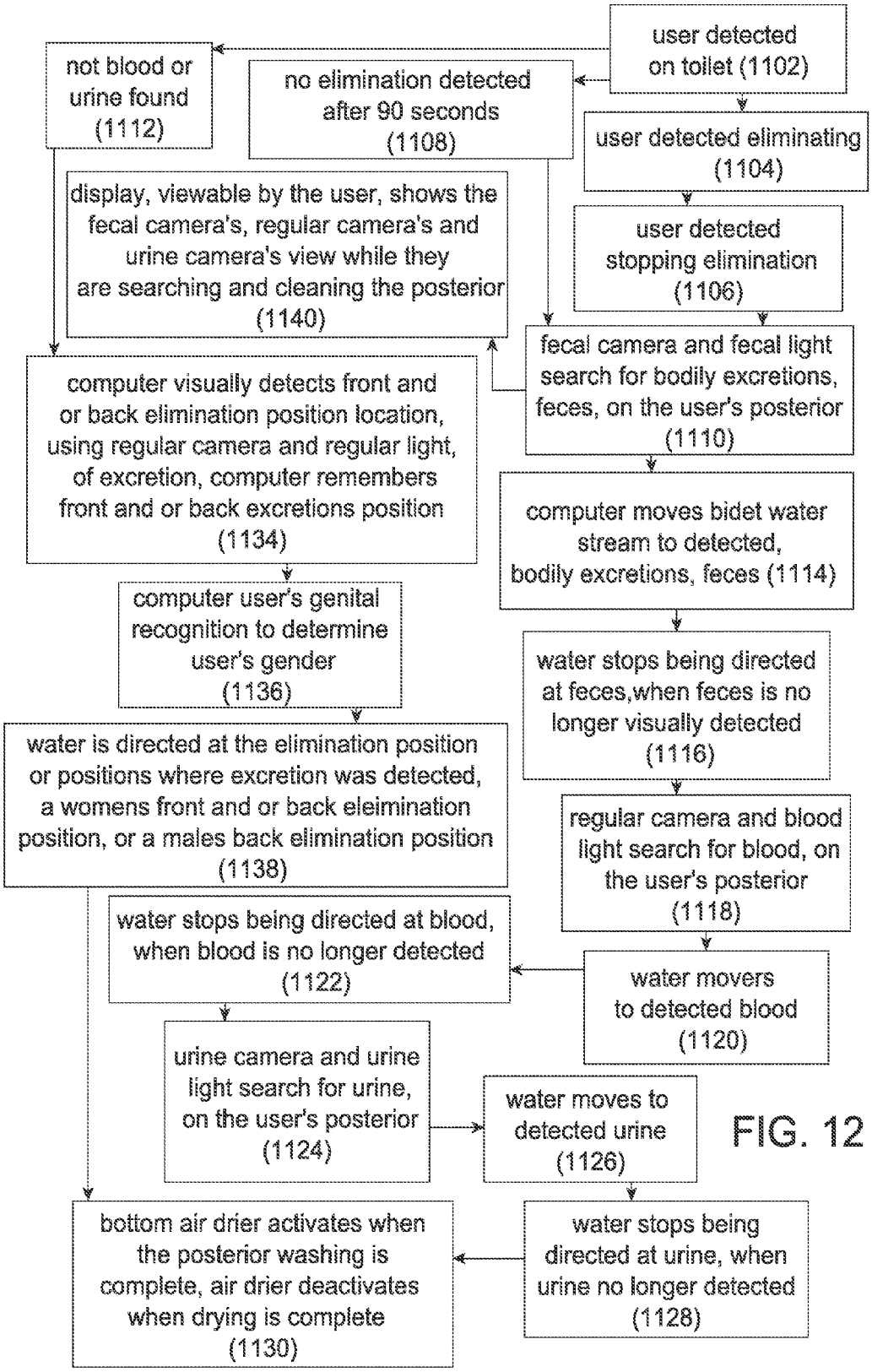
FIG. 12 shows a block diagram, showing the connection of components of an automatic bidet excretion identifying and water aiming device.
Figure 13:
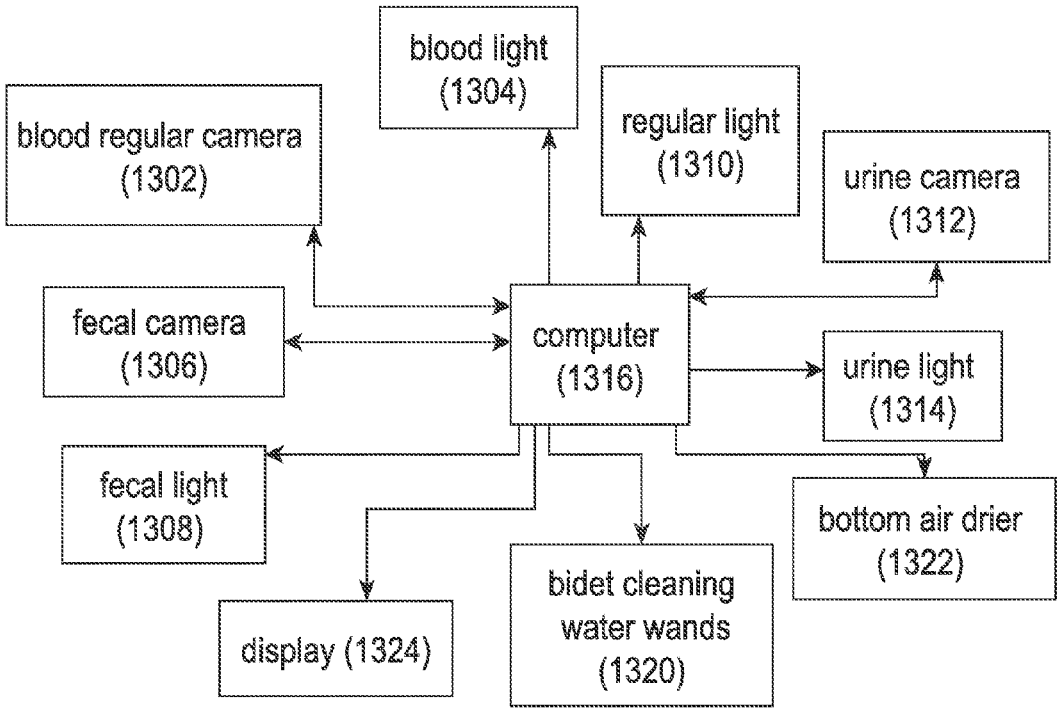
FIG. 13 is a flowchart illustrating a method of operating and an automatic bidet excretion identifying and water aiming device.

In the device software and operation flowcharts the following steps of the automatic excretion identifying bidet operations, as shown in FIGS. 10 and 12. The computer program instructions may also be loaded onto a computer or other programmable data processing apparatus, to cause a series of operational steps to be performed on the computer 106, or other programmable apparatus to produce a computer implemented process, such that, the instructions which execute on the computer 106, or other programmable apparatus provide processes, for implementing the functions or acts specified, in the flowchart and or block diagram block or blocks. FIG. 13 shows a block diagram of showing the connection of components of the automatic excretions identifying bidet. Bidet components may include, blood regular camera (1302), blood light (1304), fecal camera (1306), fecal light (1308), regular light (1310), urine camera (1312), urine light (1314), computer (1316), bidet cleaning water wands (1320), bottom air drier (1322) and display.

In the software and operation flowchart description of the automatic excretions identifying bidet, the following steps illustrate the bidets software's operation, as shown in FIG. 12, user detected on toilet (1102), user detected eliminating (1104), user detected stopping elimination (1106), fecal camera and fecal light search for bodily excretions, feces, on the user's posterior, (1110), computer moves bidet water stream to detected, bodily excretions, feces (1114), water stops being directed at feces, when feces is no longer visually detected (1116), regular camera and blood light search for blood, on the user's posterior (1118), water movers to detected blood (1120), water stops being directed at blood, when blood no longer detected (1122), urine camera and urine light search for urine, on the user's posterior (1124), water moves to detected urine (1126), water stops being directed at urine, when urine no longer detected (1128), bottom air drier activates when the posterior washing is complete, air drier deactivates when drying in complete (1130), no elimination detected after 90 seconds (1108), not blood or urine found (1112, display, viewable by the user, shows the fecal camera's, regular camera's and urine camera's view while they are searching and cleaning the posterior (1140), computer visually detects front and or back elimination position location, using regular camera and regular light, of excretion, computer remembers front and or back excretions position (1134), computer user's genital recognition to determine user's gender (1136), and water is directed at the elimination position or positions where excretion was detected, a women's front and or back elimination position, or a males back elimination position (1138).

In addition, for the method and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive.

The computer may further include on-board data storage, such as memory coupled to the processor. The memory may store software that can be accessed and executed by the processor, for example. The host may be any type of computing device or transmitter including a laptop computer, a mobile telephone, etc., that is configured to transmit data to the device. The host and the device may contain hardware to enable the communication link, such as processors, transmitters, receivers, antennas, etc.

The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

An Intel perceptual computing software developer's kit could be used to build applications for the bidets aiming devices, operating and applications. The Microsoft Software Developers Kit can be used build smart bidet function applications. Various programming languages can used to program the computer 106 such as C++, C#, and Microsoft Visual Studio Ultimate, Microsoft Visual Programming Language, Microsoft NET, Silverlight, Microsoft Robotics Developers Studio application, facial recognition, genital recognition software and Visual Basic.NET, possibly using C#, and 3D simulation tools. The computer may be programmed using, the Microsoft windows commercial software development kit, or Linux operating system, or Android operating system, or apple operating system.

Computer program code for carrying out operations of the object detection and selection mechanism may be written in any combination of one or more programming languages, including an object oriented programming language such as Java, Smalltalk, C++ or the like and conventional procedural programming languages, such as the "C" programming language or similar programming languages.

The program code may execute entirely on the computer, partly on the computer, as a stand-alone software package, partly on the computer and partly on a remote computer or entirely on the remote computer or server. In the latter scenario, the remote computer may be connected to the computer through any type of network, including a local area network (LAN) or a wide area network (WAN), or the connection may be made to an external computer (for example, through the Internet using an Internet Service Provider).

The computer is located in the display and connects to the bidet using the wireless connection. The communication link between the input display and the bidet is a wireless connection, such as Bluetooth, IEEE 802.11 (IEEE 802.11 may refer to IEEE 802.11-2007, IEEE 802.11n-2009, or any other IEEE 802.11 revision), or other wireless based communication links. In another example, the system includes an access point through which the device may communicate with the internet. In this example, the device may not require connectivity to the host. The access point may take various forms. For example, if the device connects using 802.11 or via an Ethernet connection, the access point may take the form of a wireless access point (WAP) or wireless router. As another example, if the device connects using a cellular air-interface protocol, such as a CDMA or GSM protocol, the access point may be a base station in a cellular network that provides Internet connectivity via the cellular network.

As such, the device may include a wired or wireless network interface through which the device can connect to the access point. As an example, the device may be configured to connect to access point using one or more protocols such as 802.11, 802.16 (WiMAX), LTE, GSM, GPRS, CDMA, EV-DO, and/or HSPDA, among others. Furthermore, the device may be configured to connect to access point using multiple wired and/or wireless protocols, such as "3G" or "4G" data connectivity using a cellular communication protocol (e.g., CDMA, GSM, or WiMAX, as well as for "Wi-Fi" connectivity using 802.11). Other examples are also possible. Alternatively, the host may also include connectivity to the internet, and thus, the device may access the internet through the host.

Figure 14:
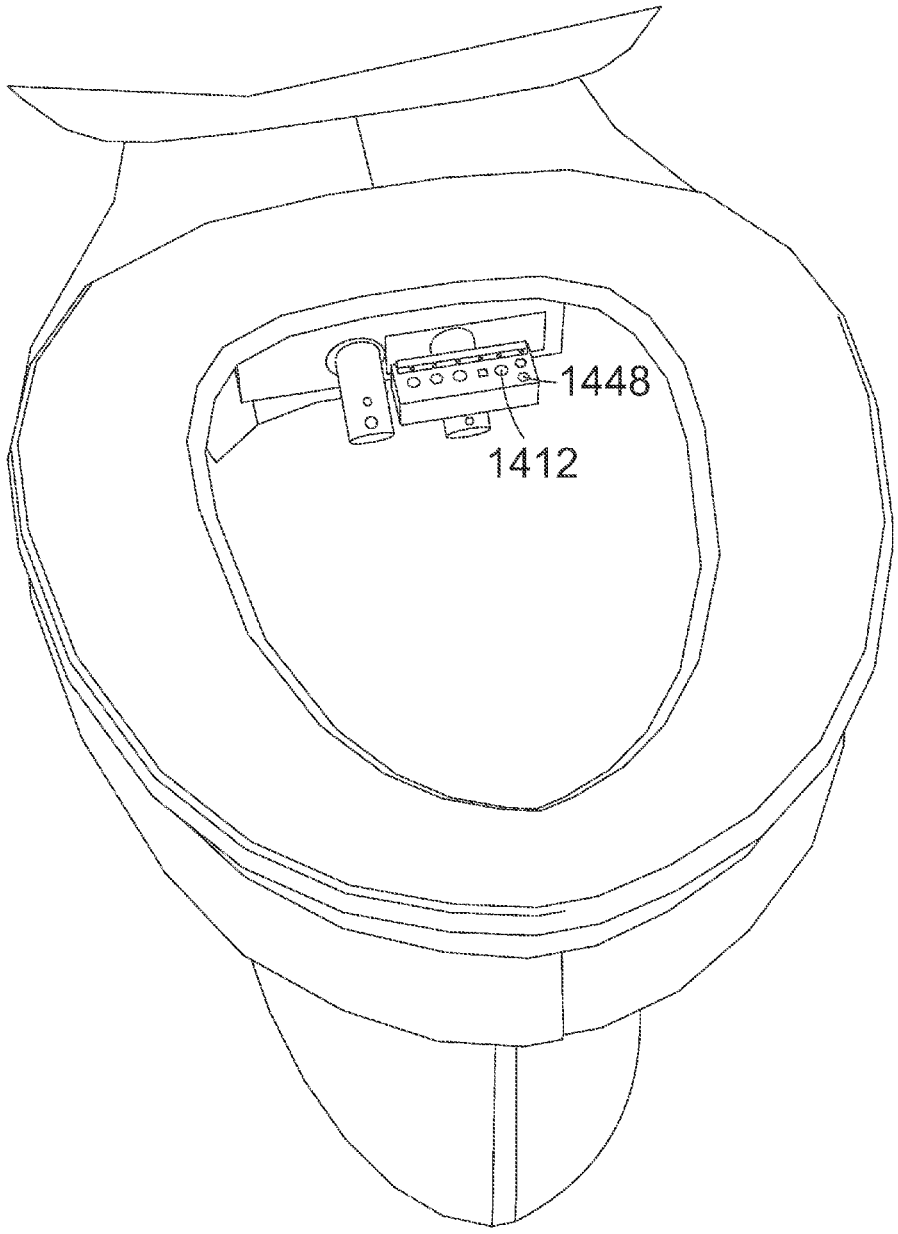
FIG. 14 shows a perspective view of an automatic bidet excretion identifying and water aiming device, and a display.

When an Automatic Excretions Identifying Bidet Doesn't Detect Bodily Excretions the Detected Excretion Position is Washed Description and Operation When an automatic excretions identifying bidet doesn't detect bodily excretions on a posterior, the computer will use a elimination position, which elimination was detected being excreted from, and wash that location, as illustrated in FIG. 14. The computer visually detects excretions from the front and or back elimination position, using a regular camera 1412 and a regular light 1448. The computer remembers the front and or back excretion's position. The computer user's genital recognition to determine the user's gender. Knowing the user's gender, and the position and or positions of excretion, the computer can determine which front and or back elimination position to wash. Water is directed at the elimination position or positions where excretion was detected. A women's front and or back elimination position, or a males back elimination position is cleaned.

Using facial recognition software adapted to recognize female and male genitals, the computer recognizes female or male genitals, and back elimination positions. The software is used for recognizing individual user's by recognizing their genitals, and or back elimination positions. The computer is located in the input display.

Figure 15:
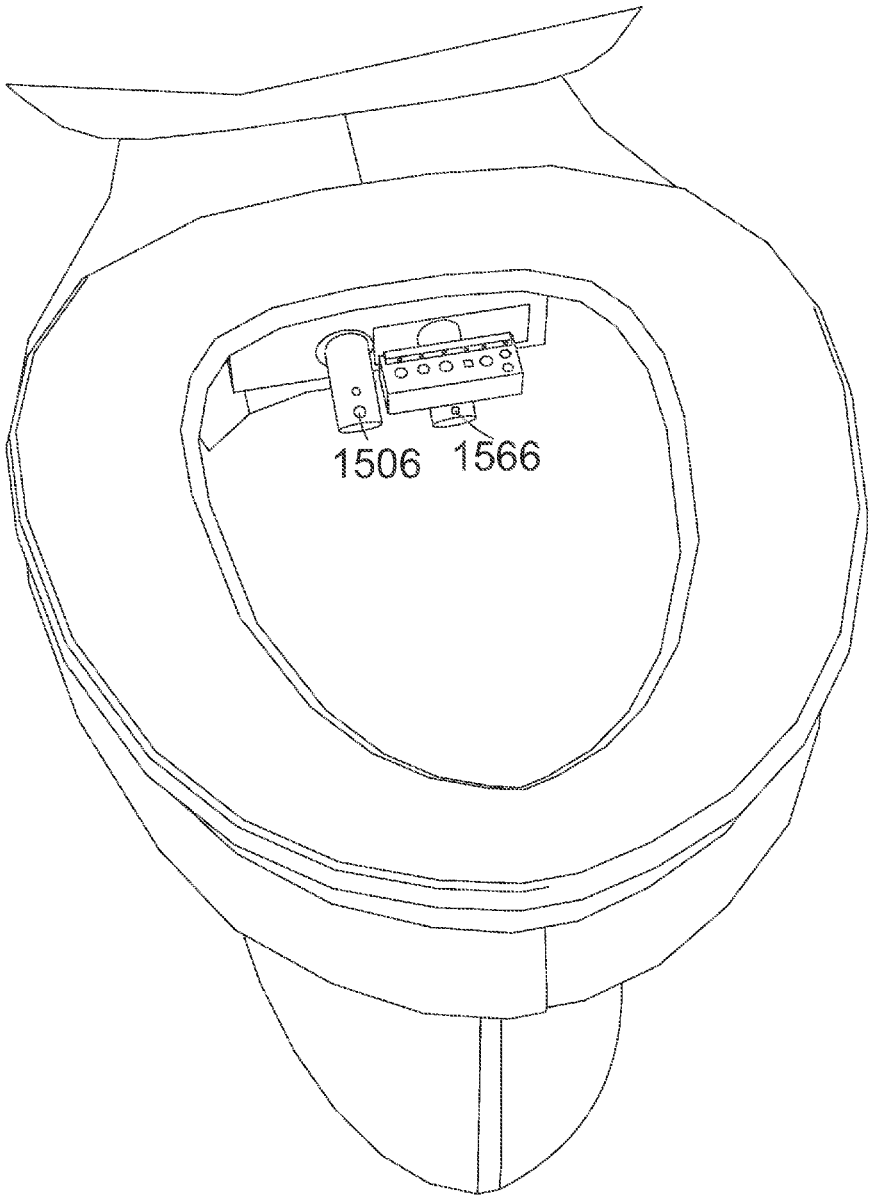
FIG. 15 shows a perspective view of an automatic bidet excretion identifying and water aiming device, and a display.

When an Automatic Excretions Identifying Bidet Doesn't Detect Bodily Excretions, Both Positioned are Washed When an automatic excretions identifying bidet doesn't detect bodily excretions, no elimination is detected, the bidet will wash the users front and back elimination locations, illustrated in FIG. 15. The bidet will move the two washing wands 1506, 1566, and wash the front and back elimination position simultaneously. Washing both locations lets the user know that they have been washed.

Figure 6:
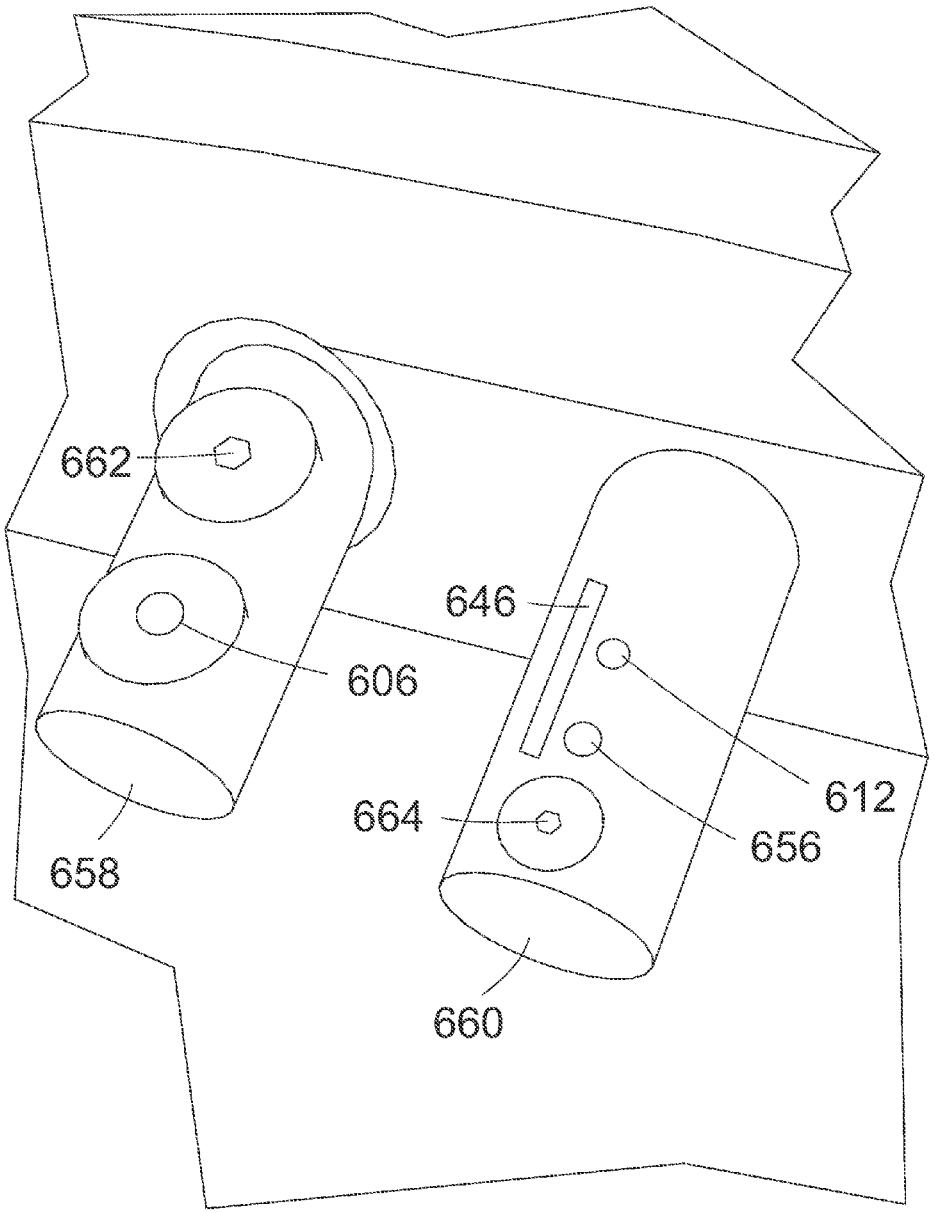
FIG. 6 shows a close up perspective view of a manually operated excretion identifying bidet, with a camera which has light filters, and a light which has light filters, and two simultaneously cleaning water nozzles.
Figure 7:
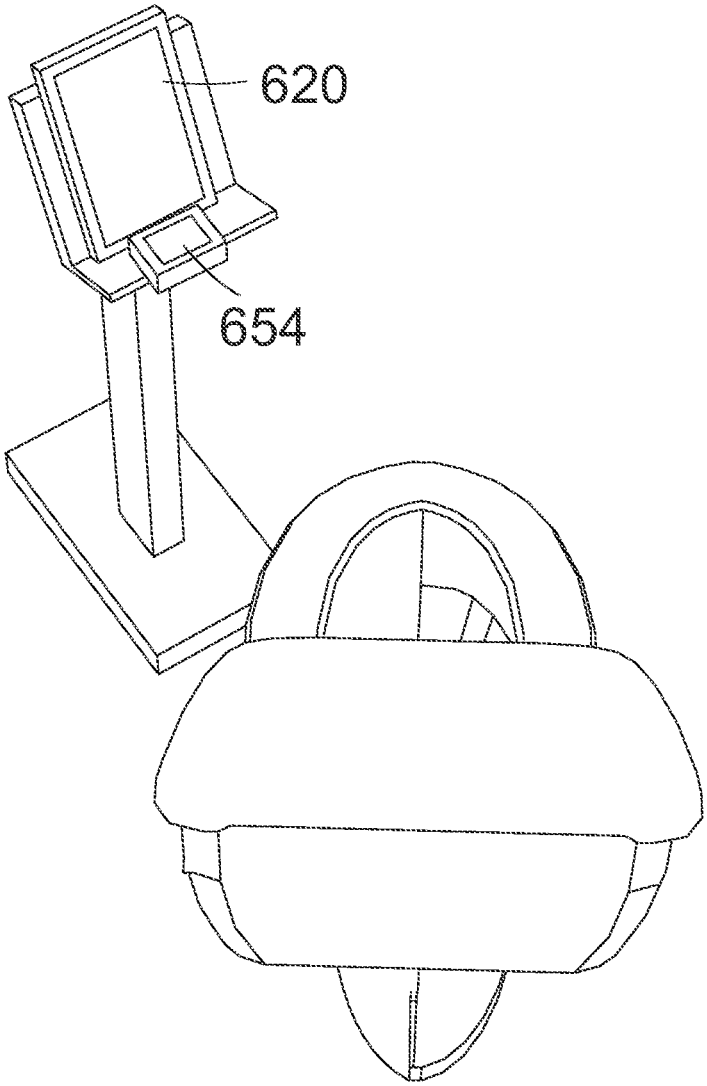
FIG. 7 shows a perspective view a manually operated excretion identifying bidet, a mid-air hand gesture sensor, and a mid-air hand gesture input display.

A User Aims a Moveable Bidet Water Stream after Moving the Stream to a Default Front or Back Location Elimination Position Description and Operation The user touch activates either the front or back default position touch button on the display 620, shown in FIGS. 6 and 7. The computer moves the water nozzle to the front or back position. Two cleaning wands 658, 660 each having a water nozzle are used to clean the elimination positions. One nozzle 664 cleans the front elimination position, and a second nozzles 606 cleans the back elimination position. The cleaning wands moves to either the front or back position. When the cleaning nozzle reaches the position, it cleaning where it thinks the user's elimination positions should be, a default elimination cleaning position. After the default cleaning is finished, the user then cleans any remaining excretions on the posterior.

The user's uses a water moving input device to move the water to a desired location on the posterior. The user views a highlighting of the excretions on the display. The view of the water contacting the excretions is shown on the display. An air drier nozzle 662 is attached to the back elimination position cleaning wand 606.

A camera 664 has two light filters which can cover the camera lens. One filter is used for detecting feces, and one for detecting urine. The filters are between the lens covering and the lens. The filters mechanically move over the lens. The filter associated with the excretion that is searched for covers the lens. The filters cover the lens, and are used individually. When the camera is unfiltered, no light filters, the camera is used to detect blood, which can be detected without light filters.

A light emitting diode LED 612 is used which illuminates feces, blood, and urine, by producing different light wave lengths. The light uses regular light using no filters over the light to illuminate blood. A urine illuminating light filter covers the light 612, and produces urine illuminating light 612. A feces illuminating light filter covers the light 612, and produces feces illuminating light. The filters move mechanically over the light source, covering the radiating light, producing the wave length of light for the specific light filter, and specific excretion.

When fecal matter is searched for, the camera, has a fecal matter light filter, which covers the camera lens 656. The feces illuminating light 612 is activated, fluorescing the feces. Water is sprayed on the highlighted feces. When blood is searched for, the blood is illuminated, by a blood illuminating light 612, and the camera has no light filters, the camera 656 looks for darkened areas that are created by the light. When urine is searched for, the urine light filter covers the lens of the camera 656. The urine illuminating light 612 is activated, fluorescing the urine. Water is sprayed on the highlighted urine. Air nozzles 646 blow water and fecal matter off, the camera's lens covering.

The user uses a Leap mid-air three dimensional 3D mid-air hand gesture sensor 654, to control the movement of the water stream. The user inputs into a displayed bidet control panel without touching the displayed panel. The user activates either the front or back default position button on the display 620. The movements of the water stream contacting the posterior is displayed on the display. The cleaning wands move to either the front or back position. At the desired position the user directs the water stream at the elimination position and surrounding the area.

The user uses mid-air hand gestures, to input into the mid-air hand gesture sensor. The hand's gestures input directs the movement of the wands water stream. Mid-air hand gesture inputs, lets the user avoid touching the control panel surfaces, which may be contaminated with bacteria. Using mid-air hand gestures, increases the already very sanity toilet environment, created by not having to touch elimination positions with fingers. The touch free bidet, and the touch free bidet input display allows the user a bacterial free toilet experience.

The user discontinues the water stream, and touch screen activates the posterior air drier 662. The user activates an elimination position air drier, which blows warm dry air out of a nozzle in the bidet wand. The user uses mid-air hand gestures to input into, the mid-air hand gesture input sensor, to move the air stream, to the desired location on the posterior. Water identifying software is used to highlight the water on the display. The user views on the display, air stream's contact on the water.

When the user has washed their posterior, the posterior is dried by a warm air blower blowing warm air over the posterior. The warm air dries the posterior. When the posterior is dry the user vacates the toilet.

The user can record the camera views, camera's video to the computer. The video of the viewing of the posterior, can be saved to an internet cloud. The computer can be connected to an internet, and computer files can be upload address on the internet. The video can be shown to health workers, for possible heath diagnosis, if the user sees something on their posterior that may be of a health concern.

Safety features include using a ground fault circuit interrupter GFCL. The GFCL is an electrical device that disconnects a circuit whenever it detects, that the electrical current is not balanced between the energised conductor and the return neutral conductor. Such an imbalance may indicate current leakage, through the body of a person, who is grounded and accidentally touching an energised part of the circuit. The GFCL are designed to disconnect quickly enough, to prevent injury caused by such shocks.

When the word connected is used, in the reference to the bidet's assemblage of electrical components, it's implied that the electrical components, are connected by electrical wire, and or information conducting, communicating wire. Other components may use other connections, such as, components which are attached by a physical connection, or connected by radio waves, etc. Water is supplied to the bidet by a connection to a building water supply.

A Computer Aims a Moveable Bidet Water Stream at a User's Elimination Positions Description An automatic water aiming bidet, device automatically locates the user's front or back elimination position, and aims a water stream at the position. The user doesn't need to move their front or back elimination position to the water stream, the water stream moves to the user's front or back elimination position.

Figure 8:
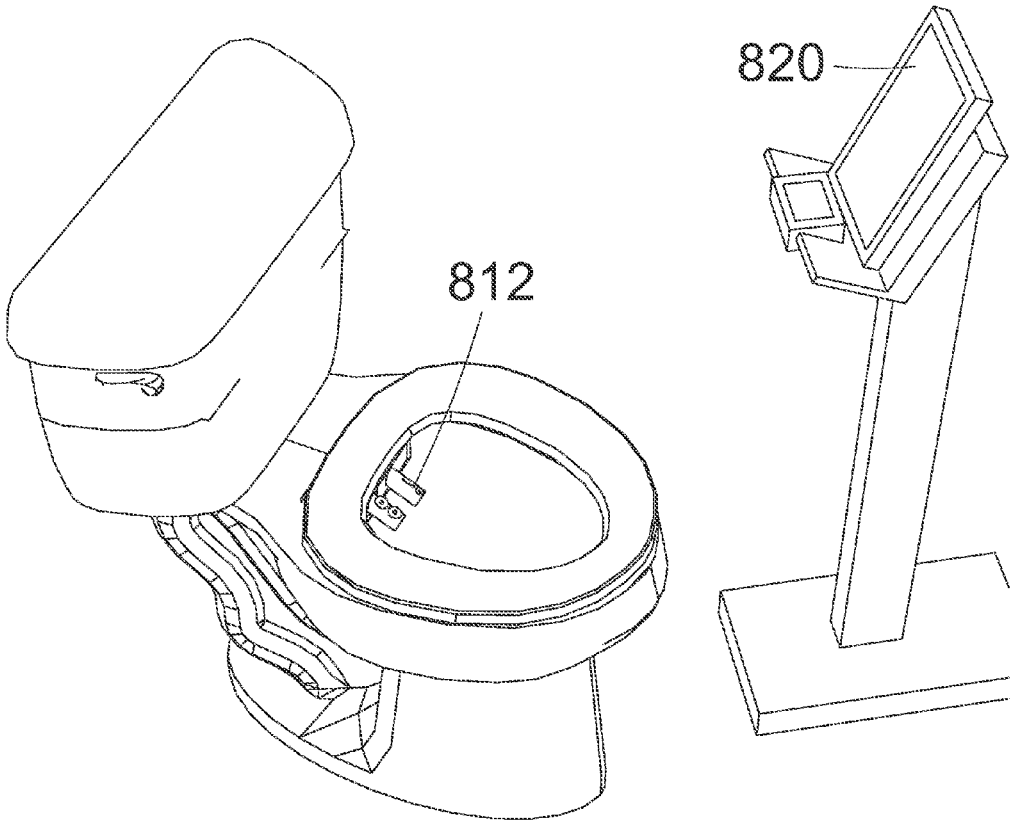
FIG. 8 shows a perspective view an automatic water aiming bidet, a toilet, and, a display.

A user activates either the front or back default position touch button on the display 820, as illustrated in FIG. 8. An automatic bidet can also detect the bidet water nozzle to the user's front or back elimination position. When the cleaning nozzle reaches the position, the computer identifies the user's back or front elimination potion, and its location. The computer aims the water stream at the elimination position, and the surrounding area.

The computer detects when the nozzle reaches the front or back position. The user's activation directs the bidet wand nozzle to either the user's front or back elimination position.

A light is attached to a bidet cleaning wand, and illuminates the elimination position. A camera 812 is attached to the bidet cleaning wand, and connected to the computer, and is used to visualize the elimination position.

At the user' front or back elimination position, the camera is used to visually search for the user's elimination position. The computer identifies the elimination position. The elimination position's location is identified. The bidet streams water to the identified elimination position, and surrounding area. The water cleans the elimination position and area. The computer visually monitors the water's stream on the elimination position, to maintain the stream on the desired position. If the user moves, the water stream will follow the elimination position. The computer uses anal recognition software, penile recognition software, and vulva recognition software, to visually identify the user's elimination potions.

An air aiming air drier is used to dry the posterior after the washing has finished. An air nozzle in the wand, blows air out of the nozzle. The computer aims the air nozzle at the elimination position. The blown air is used to dry the posterior, after it is washed. The air nozzle moves, with the movements of the wand.

The aim identifies the user's front or back elimination position, by matching the user's images to stored images of front or back elimination positions in the computer. Front and back user recognition can use various, recognition systems. Facial recognition algorithms are adapted for genital recognition. The genital recognition identify genital features by extracting landmarks, or features, from an image of the subject's genitals. For example, an algorithm may analyze the relative position, size, and/or shape of the genitals. These features are then used to search for other images with matching features.

Other algorithms normalize a gallery of genital images and then compress the genital data, only saving the data in the image that is useful for genital recognition. A probe image is then compared with the genital data. Another system is based on template matching techniques applied to a set of salient genital features, providing a sort of compressed genital representation. Recognition algorithms can be divided into two main approaches, geometric, which looks at distinguishing features, or photometric, which is a statistical approach that distills an image into values and compares the values with templates to eliminate variances.

Recognition algorithms include Principal Component Analysis using faces, Linear Discriminate Analysis, Elastic Bunch Graph Matching using the Fisher face algorithm, the Hidden Markov model, the Multi linear Subspace Learning using tensor representation, and the neuronal motivated dynamic link matching. Three-dimensional face recognition. This technique uses 3D sensors to capture information about the shape of a genital. This information is then used to identify distinctive features on the surface of a genital, such as the contour of the genitals. One advantage of 3D genital recognition is that it is not affected by changes in lighting like other techniques. It can also identify genitals from a range of viewing angles, including a profile view. Three-dimensional data points from genitals vastly improve the precision of genital recognition. Sensors work by projecting structured light onto the genitals. Up to a dozen or more of these image sensors can be placed on the same CMOS chip—each sensor captures a different part of the spectrum.

Another genital recognition process uses the visual details of the skin, as captured in standard digital or scanned images. This technique, called skin texture analysis, turns the unique lines, patterns, and spots apparent in a person's skin into a mathematical space. Tests have shown that with the addition of skin texture analysis, performance in recognizing faces can increase 20 to 25 percent computer.

A Computer Aims a Moveable Bidet Water Stream at their Elimination Positions Operation The user presses the front wash icon shown on the display screen 820, as illustrated in FIG. 8. The bidet wand water nozzle moves to the default front elimination position. The user views the aiming of the water stream at their elimination position. The user views their elimination positions being washed. After the elimination position is washed, the computer aims the air drying nozzle at the elimination position. Warm air flows out of the air dyer nozzle, physically removing water, and evaporating the water. The air drier located at the back of the toilet is used simultaneous, with the wand air drier, to blow warm air over the posterior, and dry the posterior.

Figure 9:
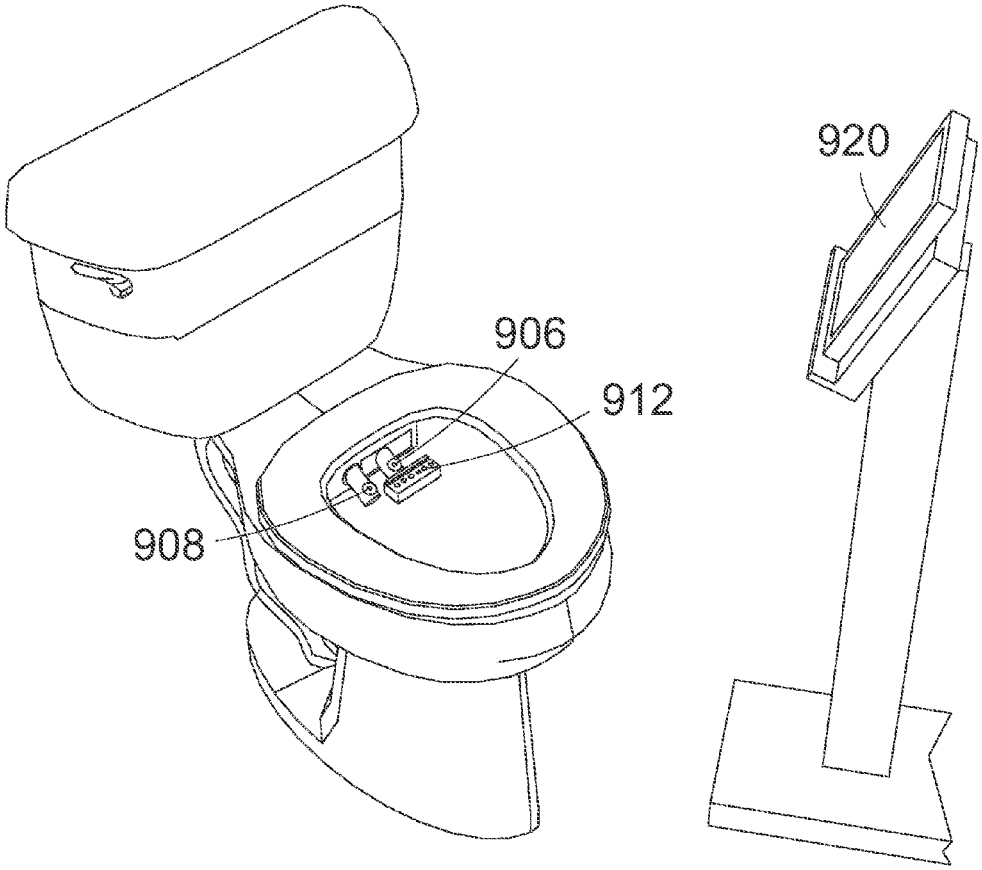
FIG. 9 shows a perspective view of an automatic bidet, an automatic water aiming bidet, and an automatic excretions identifying bidet, a toilet, a computer programmed with user profile recognition software, and a display.

An Automatic Bidet, an Automatic Water Aiming Bidet, and an Automatic Excretions Identifying Bidet Used Together Description and Operation An automatic bidet, an automatic water aiming bidet, and an automatic excretions identifying bidet are used together to wash a user's posterior. The automatic bidet moves the water nozzle to the elimination position which has been used. The automatic water aiming bidet, aims water at the user's elimination positions. The excretion detecting bidet detects excretions, that may not of been cleaned by the automatic water aiming bidet The automatic bidet is used to automatically move the bidet's, water stream to a user's front and or back location, shown in FIG. 9. The automatic bidet detects which of the user's elimination positions should be cleaned, the automatic bidet moves the water to a default female front and or back elimination position, or male back elimination position. After the water is moved to the default elimination position, the automatic bidet water aiming device identifies the location of the elimination position, and streams water to the location.

Both front and back female position elimination positions can be cleaned at the same time. The computer identities the female user's gender. The computer detects when both front and back elimination positions where used to eliminate. The computer determines that both elimination positions can be wash simultaneously. After elimination has discounted, the computer visually identifies he location of both front and back elimination position. The computer visually aims the front wash water nozzle 906 at the front elimination position, and aims the wash back water nozzle 908 at the back elimination position. The water stream to both elimination positions is activated simultaneously. The water streams to both elimination positions simultaneously. The duration of the water stream can be different for the front and back positions, such as, the front position may have a shorter wash time then the back position. The time period can be set by the user, using the input display.

The excretion identifying bidet detects excretions on the posterior that may not have been cleaned by the automatic water aiming bidet. The bidet directs water at detected fecal matter, urine, and or blood.

If blood and or fecal matter is detected on the elimination position, which hasn't been used to eliminate from, the computer will move the water stream to the identified blood, urine and or feces and wash the area.

The user can also manually rewash and or dry the elimination positions. A user can view on a display 920, the automatic washing of the elimination position or elimination positions.

The user can activate the bidet to automatically wash the user's penis, though by default the bidet would only wash the male back elimination position.

The camera sends real time video images of the elimination position or elimination positions before, during, and after washing, to the computer. The computers saves the images on the display. The display can show the saved video.

The user can create a profile of bidet setting on the touch screen, and associate them to their camera viewed genitals, while sitting on the toilet seat. The bidet uses genital recognition software to recognize a user's genital, and activate a bidet user profile associated to the user.

The bidet and seat can be detached from the toilet, and attached to a different toilet. The bidet can also be permanently attached to the toilet.

When the user sits on the toilet, the camera views the user's genital and searches for a match with stored data and pictures of the user's genitals. If a match is found, the user's setting are activated. If no match is found the user may be asked, on the display, to create a profile. The profile setting may include the bidet water temperature, the air drier temperature, the time duration of the front wash cycle, a radio station setting, and an osculating water spray, etc.

Using facial recognition software adapted to recognize female and male genitalia, the computer recognizes female or male genitals, and back elimination positions. The software is adapted and used for recognizing individual user's, by recognizing their genitals, and or back elimination positions.

Conclusions, Ramifications and Scope

From the preceding description and drawings it becomes apparent that an automatic excretions identifying bidet will automatically wash a user's posterior, with the only input from the user, is their use of the toilet. The user is able to visually detect the amount of excretion on their posterior. The identifying excretions on the posterior the user, and or computer is able the visually wash them off. The hands free operation of the bidet increases the sanity operation of the bidet, by reducing the possible transference of bacteria from the bidet input display to the user's fingers. The user can view their posterior being washed by the bidet, on a display.

Thus the reader will see that at least one embodiment, of the automatic excretions identifying bidet provides a more reliable, healthier and economical device that can be used by persons of almost any age. It will be apparent that various changes and modifications can be made, without departing from the scope of the various embodiments.

While the foregoing written description of the embodiments enables one of ordinary skill to make and use what is considered presently to be the best mode thereof, those of ordinary skill will understand and appreciate the existence of variations, combinations, and equivalents of the specific embodiment, method, and examples herein. The embodiments should therefore not be limited by the described embodiments, method, and examples, but by all embodiments and methods within the scope and spirit of the embodiments. Thus the scope of the embodiments should be determined by the appended claims and their legal equivalents rather than by the examples given.

I claim:

1. An automatic water aiming and cleaning bidet comprising, (a) a bidet connected to a computer, for the computer to direct the bidet to stream water to one of a plurality of locations on a user's back and or front elimination position, for the water stream to contact bodily exactions on the user's back and or front elimination position, (b) a user input bidet water moving device connected to the computer, for the user's input to direct the computer to move the bidet's water stream to one of a plurality of locations, on the user's back and or front elimination position, (c) a camera connected to the computer, for sending views of the user's back and or front elimination position to the computer, (d) a camera moving device attached to the camera, for the camera to view one of the plurality of locations on the user's posterior, for the movement of the camera moving device to one of a plurality of viewing locations near the user's posterior, to move the camera's view to one of a plurality of locations on the user's back and or front elimination position, (e) the camera moving device connected to the computer, for the computer to direct the movement of the camera moving device to one of a plurality of viewing locations near the user's back and or front elimination position, (g) the bidet positioned inside a toilet bowel, for directing water at one of a plurality of locations on the user's back and or front elimination position while the user is sitting on the toilet, (h) the camera moving device camera positioned inside the toilet bowel, for viewing the user's back and or front elimination position while the user is sitting on the toilet, (i) an illuminating device positioned inside of the toilet bowel, for illuminating the user's back and or front elimination position, whereby the user's input directs water to the bodily excretions to one of a plurality of locations on the user's back and or front elimination position, and removes the excretions on the positions.

2. The automatic water aiming and cleaning bidet of claim 1, wherein the user input device is a user bidet water movement device, and a display, for the user's input into the bidet water movement controller device, to move the bidet water stream to a plurality of locations on the user's back elimination position, and or front elimination position, for the display to allow the user to view the water stream's location on the posterior, for the user to visually detect bodily excretions on the posterior, for the user to use the view of the water stream, to direct the water stream to visually detected bodily excretions on the posterior.

3. The automatic water aiming and cleaning bidet of claim 1, wherein the user input device is a computer excretions identifying device comprising, a blood illuminating light inside the toilet bowel, for illuminating blood on the user's back and or front elimination position, for the camera to detect the illuminated blood, a software programmed into the computer, for the camera's detecting of blood on the back and or front elimination position, to activate the computer to move bidet water stream, for the activated computer to visually move the bidet water stream to contact the detected blood, for moving the water stream to the blood on the user's back and or front elimination position, for the bidet water stream's contact of the detected blood to be viewable by the camera.

4. The automatic water aiming and cleaning bidet of claim 1, wherein the user input device is a user bidet water stream moving device, for the user to use a bidet water movement controller device, to move the bidet water stream to detected feces, further including a feces illuminating device, for illuminating feces on the user's back and or front elimination position, further including a light filter covering the cameras lens for the light filter to allow the camera to detect light from illuminated feces on the user's back and or front elimination position, further including a display connected to the computer, for the detected feces to be viewable on the display, for the view of the bidet water steam contacting one location of a plurality of locations on the user's the back and or front elimination position to be shown on the display, for the user's view of the displayed bidet water steam contacting one location on the back and or front elimination position, and the view of the detected feces to visually aid the user in directing the bidet water moving device water stream, to the detected feces on the back and or front elimination position.

5. The automatic water aiming and cleaning bidet of claim 1, further including a genital recognition software programmed into the computer, for using genital recognition to identify the user, for identify the user's genitals while they are sitting on the toilet, further including a user profile software programmed into the computer, for creating a user profile of stored bidet settings, for associating the identified user with the stored user profile of bidet settings, for the identifying of the user to activate the profile of stored settings the with the associated identified user, for activating the profile of bidet settings associated with the user, when the user's identity is matched with their profile.

6. The automatic water aiming and cleaning bidet of claim 1, wherein the user input device is a user air drier movement device, and a display, for the user's input into the air drier movement controller device, to move the air drier air stream to a plurality of locations on the user's back, and or front elimination position, for the display to allow the user to view the air dyers air stream's location on the posterior, for the user to visually detect water on the posterior, for the user to use the view of the air dyers air stream, to direct the air dyers air stream to visually detected water on the posterior.

7. The automatic water aiming and cleaning bidet of claim 1, wherein the user input device is a computer excretions identifying device comprising, a software programmed into the computer, for the camera to detect the location of illuminated bodily excretions on the user's back, and or front elimination position, for moving the water stream to the bodily excretions, for the camera to detect light from illuminated bodily excretions on the user's back and or front elimination, for the camera's detecting of bodily excretions on the back and or front elimination position, to activate the computer to move the bidet water stream, for the activated computer to visually move the bidet water stream to contact the detected bodily excretions, for the bidets water stream the contact the detected bodily excretions to be viewable by the camera.

8. A method for using a video camera and a bidet to wash a user's posterior comprising, (a) illuminating the posterior, with a light, (b) capturing images of a user's posterior while the user is sitting on a toilet, with a video camera attached to a bidet moving wand, and the bidet moving wand placed inside the toilet's bowel, (c) sending the images of the user's posterior to a computer, (d) using the images of the user's posterior to direct a bidet water stream to a location on the user's posterior, by a user input device connected to the computer, (e) directing water at the users posterior, with the bidet's water nozzle wand placed inside the toilet bowel, (f) using the user's input to direct the bidet's water stream to one and or a plurality of locations on the user's posterior, with the user input device, (g) removing bodily excretions from the posterior by the directing of the water stream at one and or a plurality of locations on the user's posterior, with the user input device connected to the computer, whereby bodily excretions are removed from the user's posterior, by the user's input into the user input device, and the aiding of the images of the posterior to direct water to differing locations on the posterior.

9. The method of claim 8, wherein the user input device is a computer excretions identifying device comprising, a light filter covering the cameras lens, for the light filter to allow the camera to detect light from illuminated urine on the user's back and or front elimination position, a urine illuminating light connected to the computer, for illuminating urine on the user's back and or front elimination position, for the camera to detect the illuminated urine, for the camera's detecting of urine on the back and or front elimination position, to activate the computer to move bidet water stream, for the activated computer to visually move the bidet water stream to contact the detected urine.

10. The method of claim 8, wherein the user input device is a user bidet water moving device, for the user to use a bidet water movement controller device, to move the bidet water stream to detected urine, further providing a urine illuminating device, for illuminating urine on the user's back and or front elimination position, further providing a light filter covering the cameras lens for the light filter to allow the camera to detect light from illuminated urine on the user's back and or front elimination position, further providing a display connected to the computer, for the detected urine to be viewable on the display, for the view of the bidet water steam contacting one location on the back and or front elimination position to be shown on the display, for the user's view of the displayed bidet water steam contacting one location on the back and or front elimination position, and the view of the detected urine to visually aid the user in directing the bidet water moving device to move the water stream to the detected urine on the back, and or front elimination position.

11. The method of claim 8, wherein the user input device is an automatic air aiming device comprising, an air drier connected to the computer, for the computer to operate the air drier, the air drier connected to an air drier moving device, the air direr moving device connected to the computer, for the computer to move the air drier to a plurality of location on the user's posterior, a software, for detecting the bidet's water nozzle location at the user's front or back elimination position, a software, for searching for the user's front or back elimination position, a female front elimination position location recognition software, for the camera's view of the user's front elimination position to allow the computer to recognizing the female front elimination position's location for the computer to visually aim the bidet air stream at the recognized female front elimination position's location, a user back elimination position recognition software, for the computer to recognize the user's back elimination position's location, for the computer to aim the bidet air stream at the user's recognized back elimination position's location.

12. The method of claim 8, further providing a water recognition software programmed into the computer, for the camera to detect water on the user's posterior for the detection of water to activate an air drier moving device, further providing an air direr attached to the air drier moving device, further providing the air direr connected to the computer, for the computer to activate the drier after the bidet's washing of the user has completed, further providing the air direr moving device connected to the computer, for the computer to direct the air drier moving device to move the air moving device nozzle to the detected water's location, for the air drier to direct air at the detected water, for the air direr to direct air at the water until the camera detects the water is removed from the location being dried.

13. The method of claim 8, wherein the user input device is an automatic water aiming device comprising, a software, for detecting the bidet's water nozzle location at the user's front or back elimination position, for searching for the user's front or back elimination position, a female front elimination position location recognition software, for the cameras view of the user's front elimination position to recognizing the female front elimination position's location for the computer to visually aim the bidet water stream at the recognized female front elimination position's location, a user back elimination position recognition software, for recognizing the user's back elimination position's location for the computer to aim the bidet water stream at the user's recognized back elimination position's location.

14. The method of claim 8, further providing a second bidet wand with a water nozzle, for directing a water stream from the second water nozzle at the female user's back elimination position, for directing the first bidet water stream at the female user's front elimination position, for simultaneously directing the second water nozzle water stream and the first bidet's water stream at the female front and back elimination positions, and further providing a software, for directing a water stream from the second water nozzle at the female user's back elimination position, for directing the first bidet water stream at the female user's front elimination position, for simultaneously directing the second water nozzle water stream and the first bidet's water stream at the female front and back elimination positions.

15. The method of claim 8, wherein the user input device is a computer excretions identifying device comprising, a software programmed into the computer, for the camera to detect the location of the illuminated bodily excretions on the user's back, and or front elimination position, for moving the water stream to the bodily excretions, for the camera to detect light from illuminated bodily excretions on the user's back and or front elimination for the camera's detecting of bodily excretions on the back and or front elimination position, to activate the computer to move bidet water stream, for the bidets water stream contact of detected bodily excretions to be viewable by the camera, for the activated computer to visually move the bidet water stream to contact the detected bodily excretions, wherein the computer comprises, a processor connected to a storage, the processor programmed with a software, for operating the plurality of the device's components further providing a display connected to the computer, for the user's front and or back elimination positions to be viewable on the display, further providing a second bidet wand with a water nozzle, for directing a water stream from the second water nozzle at the female user's back elimination position, for directing the first bidet water stream at the female user's front elimination position, for simultaneously directing the second water nozzle water stream and the first bidet's water stream at the female front and back elimination positions, further providing a software, for directing a water stream from the second water nozzle at the female user's back elimination position, for directing the first bidet water stream at the female user's front elimination position, for simultaneously directing the second water nozzle water stream and the first bidet's water stream at the female front and back elimination positions, further providing the camera connected the bidet wand movable left and right, up and down, and retractable and extendable of the wand, for viewing the user's posterior, for the computer to visually detect the removal of the excretions, for the computer to visually detect when the excretions have been removed, further providing a connection to an internet, for sending images of the posterior to health workers for the health workers to analyse the received images of the user's posterior for possible health concerns, further providing the computer having a video camera storage, for saving video images of the posterior, for viewing of the saved video, wherein the camera is a video camera, or a ultra-sonic imaging device, or an infrared imaging device, for the imaging of the posterior, for the computer to detect when the excretions have been removed, and further providing include a lens cleaning device, for the device to direct air at the lens, for the air to remove water from the lens.

16. A bidet for detecting and removing excretions excreted from a user's body that are on the posterior of the user, while the user sits on a toilet, comprising:

a illumination device positioned to illuminate the excretions, for the illumination device to illuminate the excretions, a camera positioned to view the illuminated excretions and a computer connected to the camera, for imaging the illuminated excretions, a user input device connected to the computer, for the user's input into the user input device to instruct the computer to move a water stream to locations on the excretions, the water stream connected to a bidet and the bidet connected to the computer, for the computer to use the instructions received from the user input device, to instruct the bidet to move the water stream to the locations on the excretions, whereby the excretions are detected and removed from the user's posterior, by the bidet.

17. The bidet for detecting of claim 16, wherein the camera is a urine detecting camera, for detecting urine on the user's posterior, wherein the illumination device is a urine illuminating device, for illuminating urine on the user's posterior.

18. The bidet for detecting of claim 16, wherein the camera is a feces detecting camera, for detecting feces on the user's posterior, wherein the illumination device is a feces illuminating device, for illuminating feces on the user's posterior.

19. The bidet for detecting of claim 16, wherein the camera is a blood detecting camera, for detecting blood on the user's posterior, wherein the illumination device is a blood illuminating device, for illuminating blood on the user's posterior.

20. The bidet for detecting of claim 16, wherein the user input device is a input device comprising:

a first software in the computer, for detecting the illuminated excretions in the images of the excretions, a second software in the computer, for determining a location on the posterior of the detected excretions, a bidet connected the computer and the bidet having a water stream, for the computer to instruct the bidet to move the water stream, a third software in the computer, for directing the bidet to move the water stream to the determined location of the excretions, a forth software in the computer, for initiating the directing of the water stream to the location of the excretions, when a first predetermined operating parameter of the bidet is reached, for the water stream to the location of the excretions to remove the excretions from the location of the excretions, a fifth software in the computer, for discontinuing the directing of the water stream at the location of the excretions when a second predetermined operating parameter of the bidet is detected.

21. The bidet for detecting of claim 16, wherein the user input device is a user input device comprising: a display connected to the computer, and a user water stream moving device connected to the computer, for the user's input into the user water moving device to move the water stream, for the user to view the water stream, and the excretions on the display, for the view of the excretions, and the water stream to allow the user to view how the user's input into the water stream moving device effects the location of the water stream in relation to the excretions, for the user's input into the water stream moving device to move the water stream to the excretions.

22. A bidet capable of identifying and removing excretions excreted from a user's body, which are on the posterior of the user, while the user sits on a toilet, comprising:

an illumination device positioned to illuminate excretions, for the illumination device to illuminate the excretions, a camera positioned to view the illuminated excretions and a computer connected to the camera, for imaging the illuminated excretions, a first software in the computer, for detecting the imaging of the illuminated excretions, a second software in the computer, for determining a location on the posterior of the detected excretions, a bidet connected the computer and the bidet having a water stream, for the computer to instruct the bidet to move the water stream, a third software in the computer, for directing the bidet to move the water stream to the determined location of the excretions, a forth software in the computer, for initiating the directing of the water stream to the location of the excretions, when a first predetermined operating parameter of the bidet is reached, for the water stream to the location of the excretions to remove the excretions from the location of the excretions, a fifth software in the computer, for discontinuing the directing of the water stream at the location of the excretions when a second predetermined operating parameter of the bidet is reached, whereby the excretions on the posterior are removed by the bidet, while the user sits on the toilet.

23. The bidet capable of identifying of claim 22, wherein the camera is a urine detecting camera, for detecting urine on the user's posterior, wherein the illumination device is a urine illuminating device, for illuminating urine on the user's posterior.

24. The bidet capable of identifying of claim 22, wherein the camera is a fecal matter detecting camera, for detecting fecal matter on the user's posterior, wherein the illumination device is a fecal matter illuminating device, for illuminating fecal matter on the user's posterior.

25. The bidet capable of identifying of claim 22, wherein the camera is a blood detecting camera, for detecting blood on the user's posterior, wherein the illumination device is a blood illuminating device, for illuminating blood on the user's posterior.

26. The bidet capable of identifying of claim 22, wherein the user input device is a user input device comprising, a display connected to the computer, and a user water stream moving device connected to the computer, for the user's input into the user water moving device to move the water stream, for the user to view the water stream, and the excretions on the display, for the view of the excretions, and the view of the water stream, to allow the user to view the effect of the user's input, into the water stream moving device, on the location of the water stream, in relation to the excretions, for the user's input into the water stream moving device to move the water stream to the excretions.

27. The bidet capable of identifying of claim 22, further including a water drying device having an air stream and the air stream positioned to contact water on the user's posterior and the water drying device connected to the computer, for the computer to instruct the water drying device to move the air stream to water detected on the user's posterior, for the water drying device to move the air stream to the water for the air stream to the water to remove the water, wherein the camera is a water detecting camera, for detecting water on the posterior, wherein the illumination device is a water illuminating device, for illuminating water on the posterior.

* * * * *